US006227274B1

(12) United States Patent
Koyama et al.

(10) Patent No.: US 6,227,274 B1
(45) Date of Patent: May 8, 2001

(54) TAPE CARTRIDGE FOR COAT FILM TRANSFER TOOL AND COAT FILM TRANSFER TOOL

(75) Inventors: Kouhei Koyama, Kyoto; Shigeru Tamai, Ikeda; Masatoshi Shintani, Sanda, all of (JP)

(73) Assignee: Seed Rubber Company Limited, Osaka (JP)

( * ) Notice: Subject to any disclaimer, the term of this patent is extended or adjusted under 35 U.S.C. 154(b) by 0 days.

(21) Appl. No.: 09/325,569

(22) Filed: Jun. 4, 1999

(30) Foreign Application Priority Data

Jun. 8, 1998 (JP) ..... 10-176657

(51) Int. Cl.[7] ..... B32B 31/00

(52) U.S. Cl. ..... 156/577; 156/579; 118/257; 118/76; 242/588.6; 242/160.4; 242/171

(58) Field of Search ..... 156/238, 523, 156/527, 540, 574, 577, 579; 225/46; 118/76, 200, 257; 242/160.2, 160.4, 170, 171, 588, 588.2, 588.3, 588.6

(56) References Cited

U.S. PATENT DOCUMENTS 4,849,064 * 7/1989 Manusch et al. ..... 156/577
5,281,298 * 1/1994 Poisson et al. ..... 156/579
5,310,437 * 5/1994 Tucker ..... 156/238
5,785,437 * 7/1998 Koyama et al. ..... 156/540 X
5,792,263 * 8/1998 Koyama et al. ..... 156/577 X
5,795,085 * 8/1998 Yoo ..... 156/577 X
6,062,286 * 5/2000 Koyama et al. ..... 156/577 X

* cited by examiner

*Primary Examiner*—Mark A. Osele
(74) *Attorney, Agent, or Firm*—Arent, Fox, Kintner, Plotkin & Kahn, PLLC

(57) ABSTRACT

A small, simple and inexpensive tape cartridge to be detachably mounted on a refill type coat film transfer tool to be used in lateral draw position, capable of replacing the coat film transfer tape easily, promptly and securely. A coat film transfer head for pressurizing a coat film transfer tape to a transfer area, and a flat support board are formed integrally, and a feed reel accommodating a coat film transfer tape and a take-up reel for collecting the coat film transfer tape after use are rotatably installed on this support board. The leading end pressurizing portion of the coat film transfer head H is in a linear edge form extending nearly vertical to the axial line of rotation of both reels supported on the support board, and the support board rotatably supports opposite side ends of rotary shafts of both reels supported detachably and rotatably on the rotary support shafts of the case.

28 Claims, 29 Drawing Sheets

TAPE CARTRIDGE FOR COAT FILM TRANSFER TOOL AND COAT FILM TRANSFER TOOL

BACKGROUND OF THE INVENTION

1. Field of the Invention

The present invention relates to a tape cartridge for coat film transfer tool and a coat film transfer tool, and more particularly to a mounting technique of refill type coat film transfer tape capable of exchanging coat film transfer tapes, in a coat film transfer tool for transferring a coat film such as a corrective paint layer, a marker paint layer or an adhesive layer on a coat film transfer tape onto a sheet of paper or the like.

2. Description of the Related Art

A constitution of a coat film transfer tool of this kind is disclosed, for example, in Japanese Laid-open Utility Model No. 5-13800. In this coat film transfer tool, as shown in FIG. 28, in a case (a) held and manipulated by one hand, a feed reel (c) accommodating a coat film transfer tape (b), and a take-up reel (d) for recovering the coat film transfer tape (b') after use are rotatably provided, and a coat film transfer head (f) is projecting from the leading end of the case (a) for pressurizing the coat film transfer tape (b) to the transfer area. The both reels (c), (d) are of self-winding type mutually linked through a linkage (g) so as to cooperate. The linkage (g) is composed of mutually engaged gears (h), (i) provided on the outer circumference of the reels (c), (d).

Herein, the case (a) has a flat box shape in the contour shape and dimensions and width so as to incorporate the feed reel (c) and take-up reel (d), and the flat face and back sides, that is, the face and back sides to the sheet of paper in FIG. 28 are the gripping surfaces when held and manipulated by hand.

In this coat film transfer tool, a pressurizing portion (j) of the head (f) is composed so as to guide the coat film transfer tape (b) almost opposite to the gripping surfaces of the case (a), and it is designed to be used in so-called lateral draw.

When this coat film transfer tool is used as an eraser for correcting a wrong letter or the like, it is suited to correct a part of letters written in the lateral direction such as in alphabet. That is, holding the case (a) by one hand, as shown in FIG. 28, the case (a) is moved in a specified direction (in a vertical direction to the sheet of paper in FIG. 28), while tightly pressing the coat film transfer tape (b) onto the correction area (transfer area) (k) by the pressurizing portion (j) of the head (f). As a result, the corrective paint layer of the coat film transfer tape (b) in the pressurizing portion (j) of the head (f) is adhered to the correction area (k) to cover and erase the letter, and the coat film transfer tape (b') after use is automatically taken up and recovered in the take-up reel (d).

Recently, effective use of resources on earth is demanded, and in this type of coat film transfer tool, from the viewpoint of saving of resources, it is preferred to employ the so-called refill type structure so that only the consumable part of coat film transfer tape (b) can be replaced.

In this lateral draw type coat film transfer tool, however, since the pressurizing portion (j) of the head (f) guides the coat film transfer tape (b) nearly opposite to the gripping surfaces of the case (a), it was practically impossible to realize the refill structure for replacing coat film transfer tape (b) only.

In this coat film transfer tool, structurally, the coat film transfer tape (b) is twisted 90 degrees at the head (f) portion.

Accordingly, at the manufacturer's side, it is difficult to automate the assembling work, and it is a manual work by skilled workers.

To realize the refill structure for replacing the consumable part of coat film transfer tape (b), it is the principle that disassembling and reassembling of the coat film transfer tool, and replacement of the coat film transfer tape (b) must be done by the user.

Therefore, to realize the structure for replacing the coat film transfer tape (b), it has been an essential subject to develop a structure allowing this series of jobs to be done by a general user easily, promptly and securely.

From this viewpoint, the present applicant previously proposed a refill type coat film transfer tool, for example, in Japanese Laid-open Patent No. 8-156495.

In this coat film transfer tool, as shown in FIG. 29, a tape cartridge (m) is provided in a case (a) so as to be replaced. This tape cartridge (m) consists of a feed reel (c) and a take-up reel (d) rotatably provided on a support board (n). The both reels (c), (d) are designed to be engaged with a feed rotary portion (o) and a take-up rotary portion (p) rotatably provided in the case (a) so as to be detachable and rotatable integrally. The rotary portions (O) , (p) are mutually coupled through a linkage (g) so as to cooperate with each other, and this linkage (g) is realized by mutual frictional contact between an outer O-ring (r) of the feed rotary portion (o) and an outer circumference (s) of the take-up rotary portion (p).

On the other hand, at the leading end of the case (a), a coat film transfer head (f) is projecting. This coat film, transfer head (f) can be rotated and manipulated between the exchanging position and using position of the coat film transfer tape. A leading end pressurizing portion (j) of the coat film transfer head (f) guides the coat film transfer tape (b) in the winding state of the both reels (c), (d) at the exchanging position of the coat film transfer tape, and also guides the coat film transfer tape (b) nearly opposite to the gripping surfaces of the case (a) at the using position.

When using such coat film transfer tool, same as in the case of the coat film transfer tool shown in FIG. 28, it can be used in a lateral draw, and when replacing the coat film transfer tape (b), the coat film transfer head (f) is rotated and manipulated from the using position to the exchanging position of the coat film transfer tape. As a result, the position of the coat film transfer tape (b) at the head (f) area is manipulated to a parallel state from the state twisted by about 90 degrees to the winding position of the feed reel (c) and take-up reel (d), so that the coat film transfer tape (b) may be detached and attached easily from and to the head (f).

SUMMARY OF THE INVENTION

It is hence a primary object of the invention to present a novel tape cartridge for coat film transfer tool by further improving the structure of the conventional refill type coat film transfer tool capable of using in lateral draw.

It is other object of the invention to present a tape cartridge and a coat film transfer tool having a small, simple and inexpensive structure, capable of replacing the coat film transfer tape more easily, promptly and securely.

It is a different object of the invention to present a tape cartridge capable of replacing in a single step, by forming a coat film transfer head and a flat support board integrally, and mounting a feed reel and a take-up reel rotatably on this support board.

It is also an object of the invention to present a tape cartridge to be used in lateral draw suited to correction part of letters written laterally as in alphabet, when used as an eraser, in a state of the tape cartridge disposed in the case of the coat film transfer tool.

It is a further object of the invention to present a tape cartridge capable of decreasing the number of parts for composing the tape cartridge as a consumable part, reducing and simplifying the structure, and further lowering the product cost.

It is another object of the invention to present a coat film transfer tool capable of reducing the size of the coat film transfer tool itself, and keeping portable and easy to be held and manipulated by hand, while making the best of the refill type structure of saving of resources and reduction of running cost, by comprising the aforesaid tape cartridge.

The tape cartridge of the invention is constituted by integrally forming a coat film transfer head for pressurizing the coat film transfer tape onto the transfer area and a flat support board, and mounting a feed reel accommodating the coat film transfer tape and a rotatable take-up reel for collecting the coat film transfer tape after use rotatably on this support board, in which the leading end pressurizing portion of the coat film transfer head is in a form of a straight edge extending nearly vertically to the axial line of rotation of the both reels supported on the support board, and the support board rotatably supports the opposite side ends of the rotary shafts of both reels supported detachably and rotatably on the rotary support shaft of the case.

In the constitution of the coat film transfer tool of the invention, the tape cartridge is disposed detachably, and in a case held and manipulated by one hand, there is a rotary support shaft for detachably and rotatably supporting the feed reel and take-up reel of the tape cartridge, the both reels are rotatably supported on both sides by the rotary support shaft and the support board of the tape cartridge, a head inserting portion for projecting the coat film transfer head of the tape cartridge into the outside of the case is provided at the leading end of the case, and a pair of confronting gripping surfaces are formed in part of the outer circumference of the case so as to be held by hand in a position of holding a writing implement.

In the tape cartridge of the invention, a coat film transfer head and a flat support board are formed integrally, and a feed reel and a take-up reel are rotatably mounted on this support board, so that it is possible to replace instantly.

That is, the support board is constituted to support rotatably the opposite sides of the rotary shafts of the reels supported on the rotary support shaft of the case, and setting of the coat film transfer tape on the coat film transfer head has been already completed in the product stage. Accordingly, the user is requested only to grip the support board to engage the rotary shafts of the reels with the rotary support shaft of the case from the upper side, and finishes the replacement job only by putting the tape cartridge into the case while positioning the coat film transfer head at the specified position at the leading end of the case.

The leading end pressurizing portion of the coat film transfer head is in a form of a straight edge extending nearly vertically to the axial line of rotation of the both reels supported on the support board. Therefore, in the state of the tape cartridge being disposed in the case, the leading end pressurizing portion of the coat film transfer head projecting outside from the case leading end guides the coat film transfer tape nearly oppositely to the gripping surfaces of the case, and, for example, when used in an eraser for correcting a wrong letter, it is possible to use in a lateral draw suited to a case of correction of part of letters written laterally as in alphabet.

That is, when using the coat film transfer tool, the case itself can be gripped like a writing implement, and the coat film transfer tape can be tightly adhered to the sheet of paper by the pressurizing portion of the head. By moving the case directly in the lateral direction, that is, in the lateral direction to the sheet of paper, and the corrective paint layer on the coat film transfer tape is transferred onto the sheet of paper.

The above and other related objects and features of the invention will be further clarified by referring to the detailed description given in conjunction with the accompanying drawings and novel matters indicated in the claims.

BRIEF DESCRIPTION OF THE DRAWINGS

FIG. 14 (*b*) is a perspective view showing an engagement support member of the feed reel side position.

FIG. 18 (*b*) is a perspective view showing an engagement support member of the feed reel side position.

FIG. 20 (*b*) is a perspective view showing feed rotary gear of the feed reel side position.

FIG. 21 (*b*) is a perspective view showing a case opened state of the eraser.

DETAILED DESCRIPTION OF THE PREFERRED EMBODIMENTS

Figure 1:
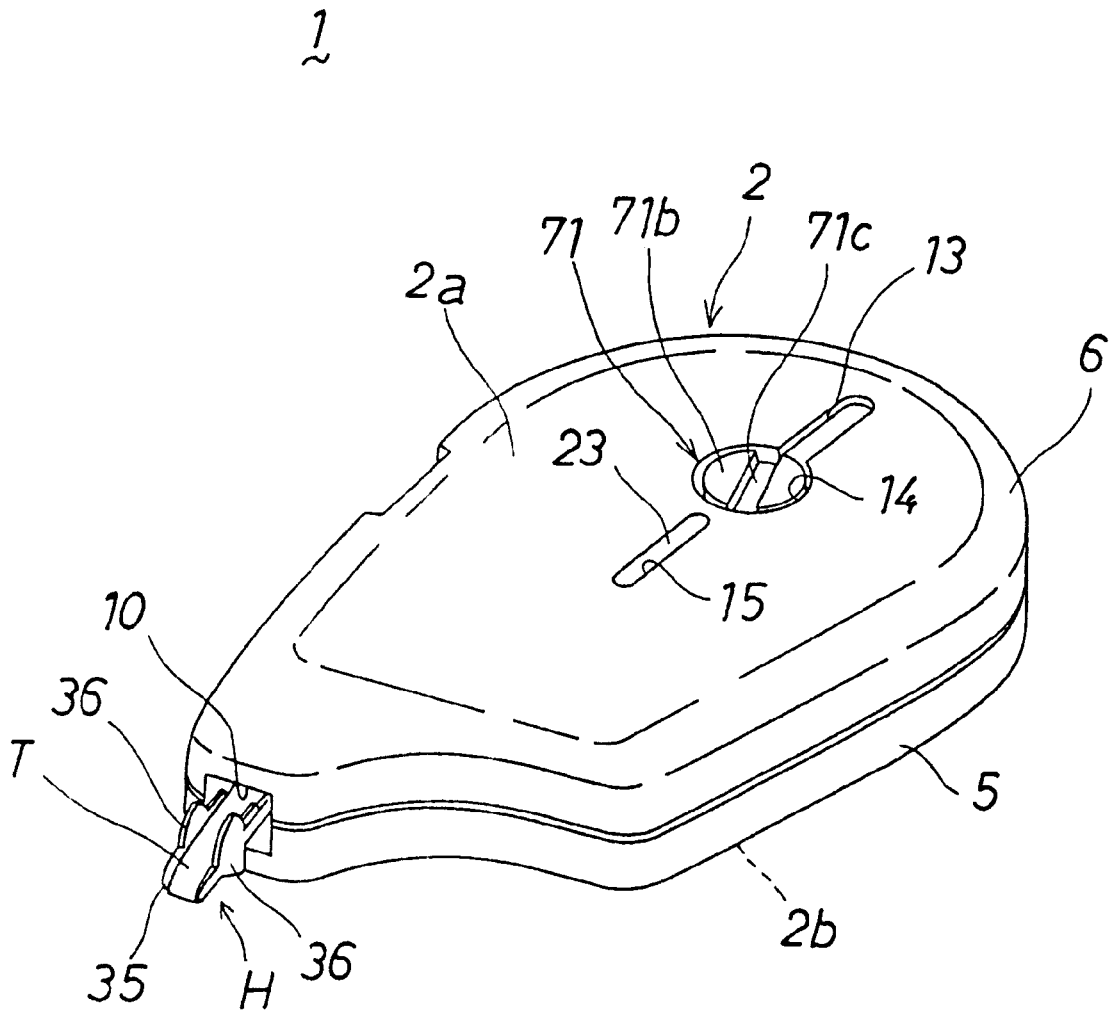
FIG. 1 is a perspective view showing an eraser in embodiment 1 of the invention.

Referring now to the drawings, preferred embodiments of the invention are described in detail below.

FIG. 1 through FIG. 27 show the tape cartridge and coat film transfer tool according to the invention, and same reference numerals throughout the drawings indicate the same constituent members or elements.

Embodiment 1

A coat film transfer tool of the invention is shown in FIG. 1 through FIG. 10. This coat film transfer tool 1 is specifically used as an eraser for correcting wrong letters or the like, being of a cartridge type capable of replacing the coat film transfer tape T as consumable part, that is, a lateral draw usable type having a refill structure.

Figure 3:
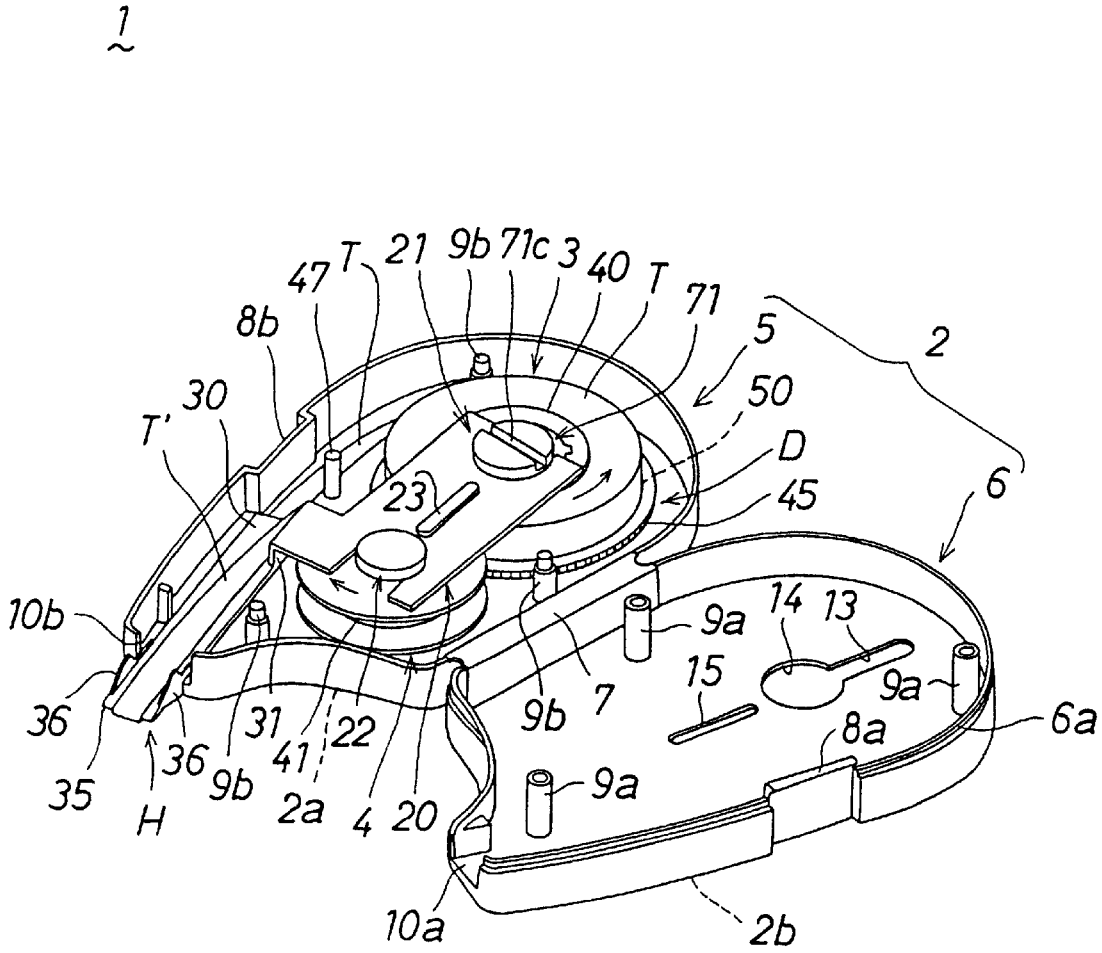
FIG. 3 is a perspective view showing a case opened state of the inside of the eraser.
Figure 4:
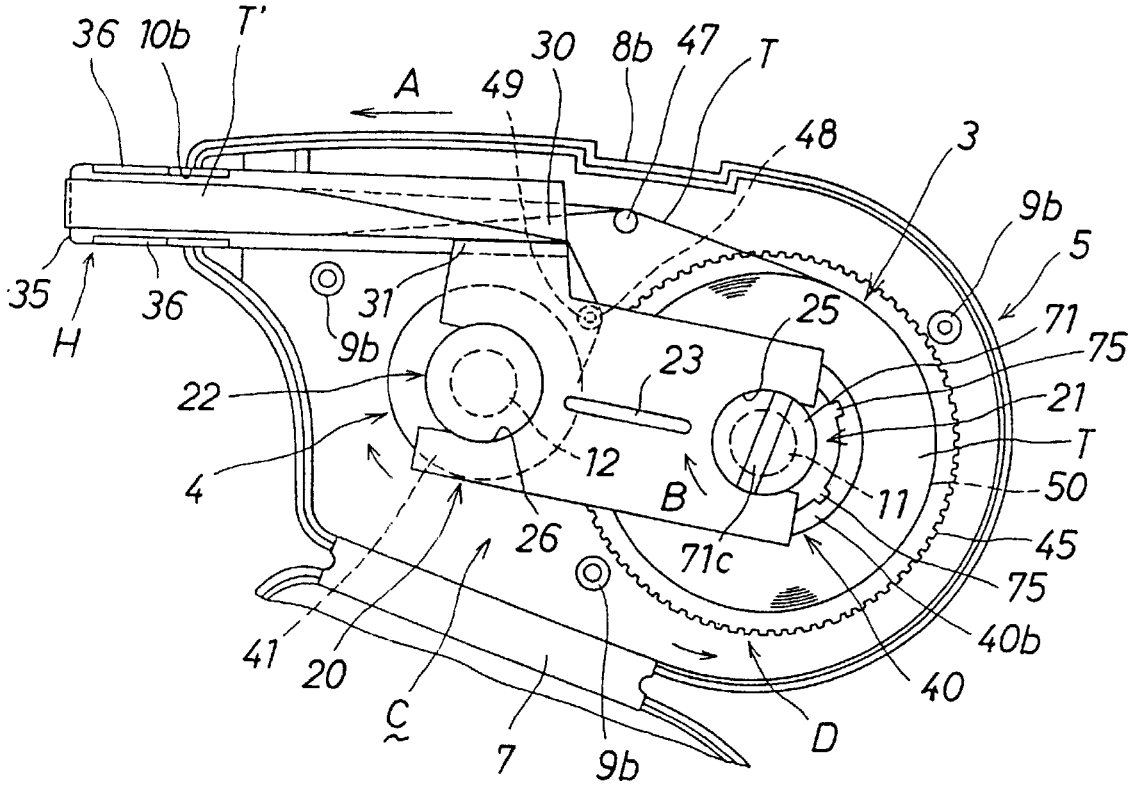
FIG. 4 is a front view showing the inside of the case main body of the eraser.

The coat film transfer tool 1 has a case 2 of which appearance is as shown in FIG. 1, and further comprises a tape cartridge C having a coat film transfer head H and a tape interlock unit (interlock mechanism) D as shown in FIG. 3 and FIG. 4. The coat film transfer tool 1 is of so-called twin-axis type reel structure having a feed reel 3 and a take-up reel 4 independently supported on the tape cartridge C. Each constituent component is described below.

I. Case 2

The case 2 has a flat box shape having the front contour shape and dimensions and width capable of incorporating the tape cartridge C and tape interlock unit D, and a pair of confronting flat face and back sides 2*a*, 2*b* are gripping surfaces when held and manipulated by hand as mentioned below.

This case 2 is made of plastics integrally formed by injection molding or the like. The case 2 is designed to be opened and closed by a case main body 5 and a cap body 6, and the tape cartridge C and tape interlock unit (interlock mechanism) D are fitted to the case main body 5.

The case main body 5 and cap body 6 are connected to be mutually oscillatable through a hinge 7 as shown in FIG. 3. In the case main body 5 at the opposite side of the hinge 7 and the opening of the cap body 6, elastic engaging portions 8*a*, 8*b* are provided. In the opening inner peripheral edge of the cap body 6, a fitting flange 6a fitted to the opening inner peripheral edge of the case main body 5 is provided in almost entire circumference. At the inner side of the case main body 5 and cap body 6, three pairs of positioning fitting portions 9*a*, 9*b* are provided oppositely.

At the leading ends of the case main body 5 and cap body 6, insertion grooves 10*a*, 10*b* are notched and formed respectively, and these insertion grooves 10*a*, 10*b* form a head insertion portion 10 for inserting the coat film transfer head H inside and outside. At the inner side of the case main body 5, hollow rotary support shafts 11, 12 for rotating and supporting the feed reel 3 and take-up reel 4 of the tape cartridge C are provided integrally.

By oscillating and arresting the cap body 6 on the case main body 5 by the fulcrum of the hinge 7, the fitting flange 6*a* is fitted to the opening inner peripheral edge of the case main body 5, and the three pair of the positioning fitting portions 9*a*,9*b* are mutually fitted. At the same time, the elastic fitting portions 8*a*, 8*b* are elastically fitted to each other, and the case 2 is closed. In the closing process of the case 2, a nearly rectangular head inserting portion 10 is opened and formed in the leading end.

On the other hand, by the completely reverse manipulation, the case 2 is opened by the case main body 5 and cap body 6.

In the cap body 6, a remainder checking window 13 for checking the remainder of the coat film transfer tape T and an opening 14 for rewind button 71 mentioned below are consecutively opened, and a slit 15 for a handling knob 23 of the tape cartridge C is also opened as described later II. Tape cartridge C The tape cartridge C is a constituent part to be exchanged as a consumable part, and its specific constitution is shown in FIG. 2 to FIG. 6.

Figure 2:
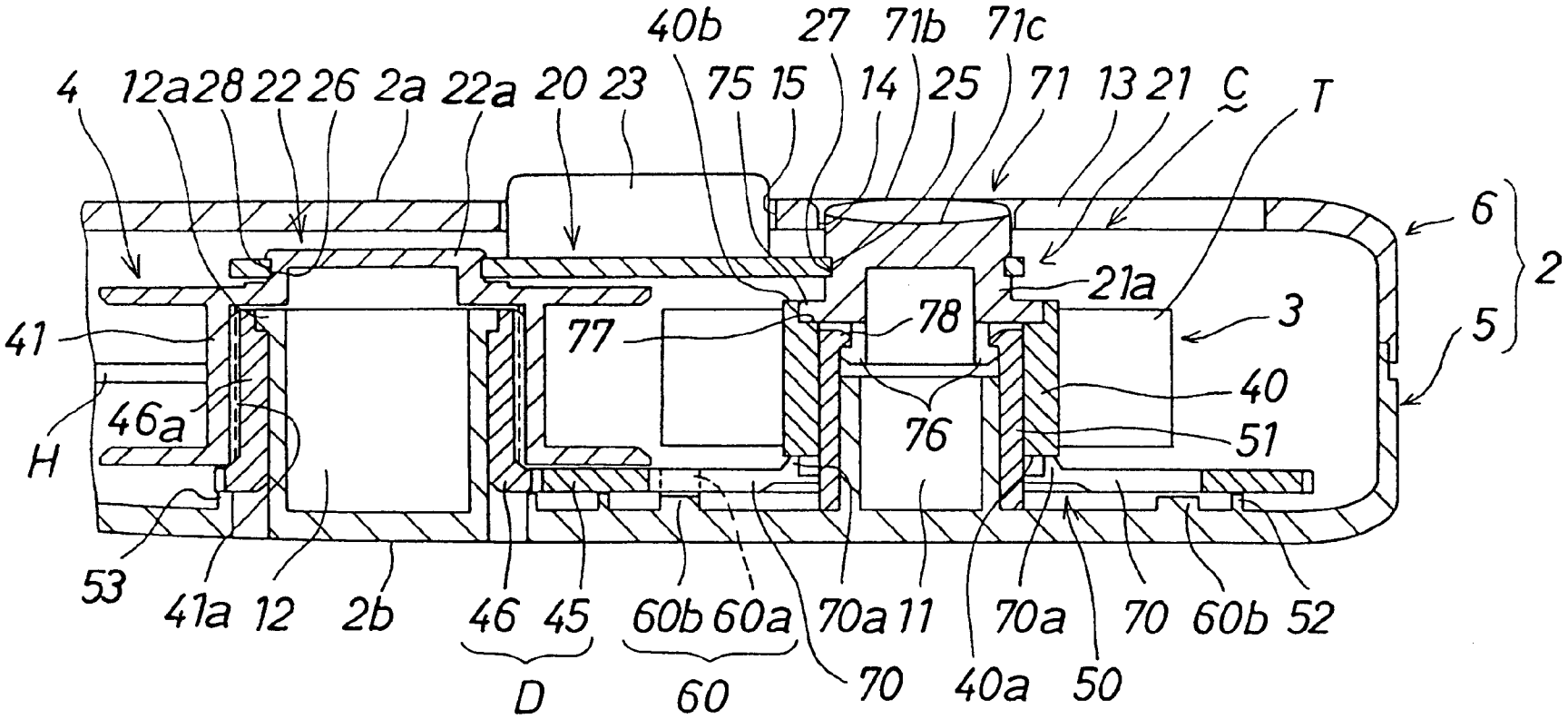
FIG. 2 is a side sectional view showing inside of principal parts of the eraser.

In this tape cartridge C, a coat film transfer head H for pressurizing a coat film transfer tape T onto the transfer area and a flat support board 20 are integrally formed, and a feed reel 3 accommodating the coat film transfer tape T and a rotatable take-up reel 4 for collecting the coat film transfer tape T' after use are rotatably disposed on this support board 20. The tape cartridge C is detachably mounted on the case main body 5 as shown in FIG. 2 to FIG. 4.

The coat film transfer head H and the flat support board 20 are plastic plates formed integrally by injection molding or the like. The material of these plates may be those capable of exhibiting the basic functions of both head H and support board 20.

The shape and dimensions of the support board 20 should be as thin and compact as possible as far as the strength for holding the both reels 3, 4 is maintained.

In the illustrated embodiment, the plane shape of the support board 20 is a rectangular shape as shown in FIG. 4, and the coat film transfer head H is integrally provided in the upper portion of its leading end.

The longitudinal length dimension of the support board 20 is set slightly larger than the maximum disposing dimension of the rotary shafts 21, 22 of the both reels 3, 4. The vertical width dimension of the support board 20 is set as small as possible within a range capable of rotating and supporting the rotary shafts 21, 22. Reference 23 shows a linear rib handling knob formed integrally on the outside surface of the support board 20.

The support board 20 is designed to support rotatably the upper side ends of the rotary shafts 21, 22 of the both reels 3, 4, that is, the ends 21*a*, 22*a* at the opposite side of the side supported on the rotary support shafts 11, 12 of the case main body 5.

In the specific rotation support structure of the both reels 3, 4 in the support board 20, bearings 25, 26 are formed in the front and rear outer circumferential portions of the support board 20, annular engaging grooves 27, 28 are formed in the entire circumference of the upper ends 21*a*, 22*a* of the rotary shafts 21, 22 of the reels 3, 4, and these annular engaging grooves 27, 28 are engaged and supported rotatably on the bearings 25, 26.

Figure 6:
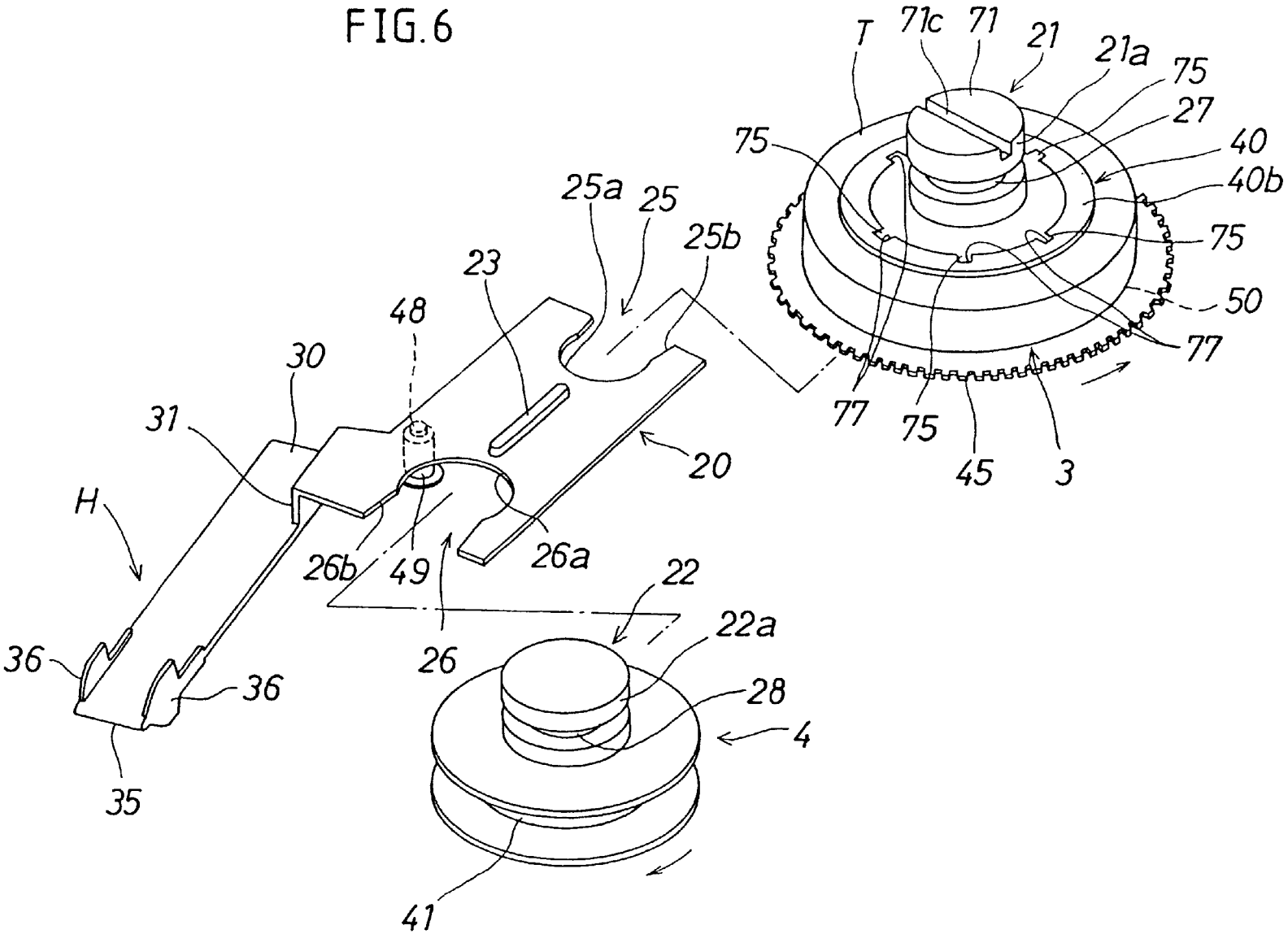
FIG. 6 is a perspective exploded view of a tape cartridge of the eraser

In the illustrated embodiment, these bearings 25, 26 are concave bearings opened to the outer edge, that is, the front and rear edges of the support board 20 as shown in FIG. 6. The plane shape of these concave bearings 25, 26 are designed in consideration of ease of assembling in the manufacturing shop.

That is, the concave bearings 25, 26 are composed of circular portions 25*a*, 26*a* having the inside diameter corresponding to the outside diameter of the annular engaging grooves 27, 28, and mounting insertion portions 25*b*, 26*b* spreading in a taper form from the circular portions 25*a*, 26*a* toward the front and rear edges of the support board 20.

Figure 5:
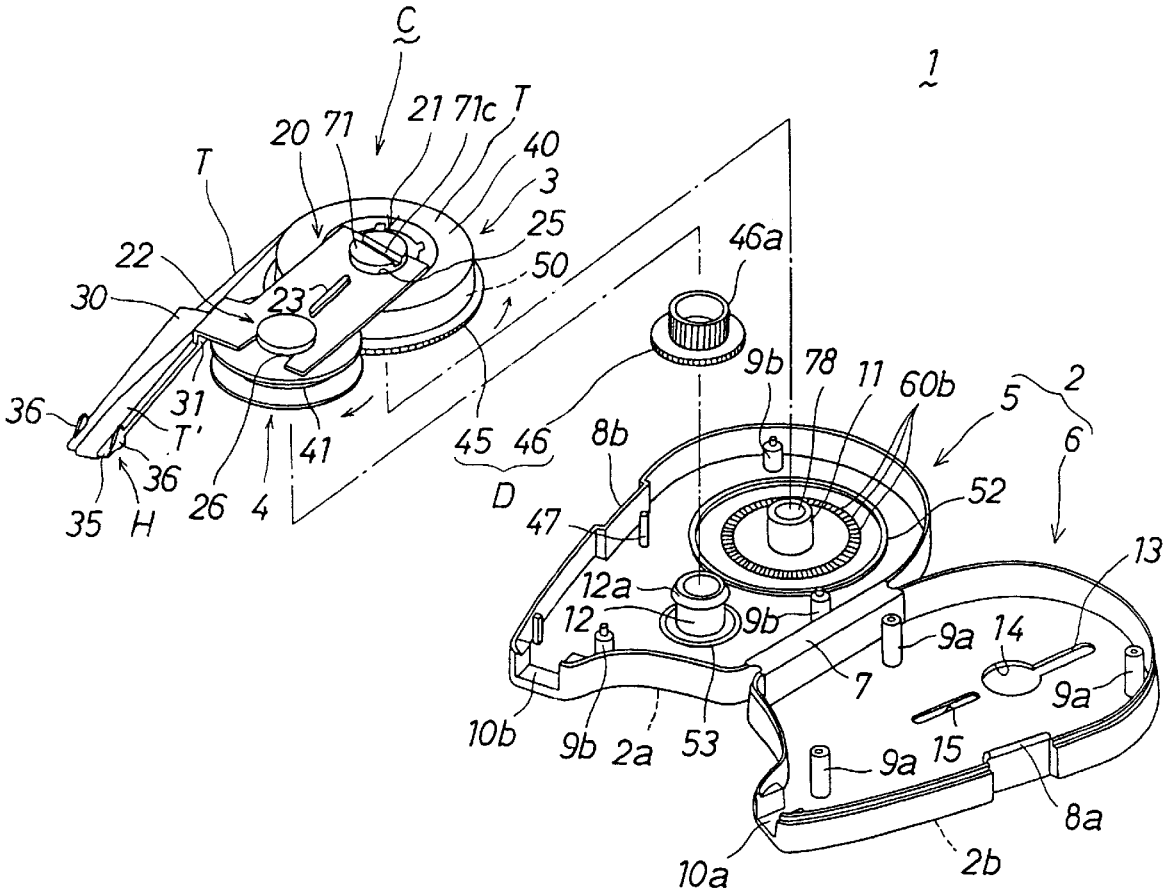
FIG. 5 is a perspective exploded view of the eraser.

The circular portions 25*a*, 26*a* of the bearings 25, 26 are disposed corresponding to the rotary support shafts 11, 12 of the case main body 5. Hence, the layout of the reels 3, 4 on the support board 20 is as shown in FIG. 4 and FIG. 5, that is, the rotary shafts 21, 22 are set to be positioned coaxially with respect to the rotary support shafts 11, 12.

The elastic engaging grooves 27, 28 of the rotary shafts 21, 22 of the both reels 3, 4 are pressed and inserted by force into the circular portions 25*a*, 26*a* from the mounting insertion portions 25*b*, 26*b*, the boundary parts of the mounting insertion portions 25*b*, 26*b* and circular portions 25*a*, 26*a* are elastically expanded, and are elastically restored again, and the annular engaging grooves 27, 28 are rotatably engaged with the circular portions 25*a*, 26*a*, so that the both reeds 3, 4 are positioned and supported at specified positions, individually.

The coat film transfer head H is intended to pressurize the coat film transfer tape T onto the correction area (transfer area) of wrong letters or the like on the sheet of paper, and it has both the guiding function and pressurizing function of the coat film transfer tape T.

More specifically, the coat film transfer head H is a rectangular plate having a certain elasticity, and its base end 30 is integrally formed at the leading end upper portion of the support board 20 through a connection portion 31. The coat film transfer head H in the illustrated embodiment is a slightly wider thin plate than the coat film transfer tape T, and has a taper section so as to be thinner gradually toward the leading end. Flat both side surfaces of the coat film transfer head H form tape running surfaces, and the leading end 35 of the coat film transfer head H is a pressurizing portion for pressurizing the coat film transfer tape T. At both side edges of the head H, guide flanges 36, 36 for guiding running of the coat film transfer tape T are formed.

The leading end pressurizing portion 35 of the coat film transfer head H is located nearly in the central position in the axial direction of the rotary shafts 21, 22 of the both reels 3, 4 supported on the support board 20.

That is, the coat film transfer head H is extended and provided parallel to the support board 20, in a state deviated nearly in the central position in the axial direction of the rotary shafts 21, 22, with respect to the support board 20, by the connection portion 31.

As a result, in the mounted state of the tape cartridge C in the case 2, the coat film transfer head H projects outside of the case through the head insertion portions 10 (10*a*, 10*b*) of the case 2, and its leading end pressurizing portion 35 is positioned in the central position in the width direction of the case 2, so that ease of manipulation and reliability of the coat film transfer tool 1 are assured.

The leading end pressurizing portion 35 of the coat film transfer head H is in a linear edge form extending almost vertically to the rotation axial line (that is, the axial line of rotary shafts 21, 22) of the both reels 3, 4 supported on the support board 20. Therefore, the leading end pressurizing portion 35 of the head H guides the coat film transfer tape T so that the face and back sides of the coat film transfer tape T may face nearly the same direction (parallel) to the gripping surfaces 2*a*, 2*b*, nearly opposite to the griping surfaces 2*a*, 2*b* of the case 2, so that it is possible to use in a lateral draw position as mentioned below.

The feed reel 3 has a hollow cylindrical tape core 40 for accommodating a virgin coat film transfer tape T, and also comprises a clutch mechanism 50 cooperating with this tape core 40, and a feed rotation gear 45 of the tape interlock unit D. A specific assembling structure of the feed reel 3 is described below in relation to the clutch mechanism 50. The take-up reel 4 is to take up and collect the used coat film transfer tape T', and the leading end portion of the coat film transfer tape T is connected to the outer circumference of the hollow cylindrical tape core 41.

The tape core 41 serves part of the rotary shaft 22 of the take-up reel 4. The upper end of the axial direction of the tape core 41 is integrally formed coaxially with the upper side end portion 22*a* mentioned above, and this upper side end portion 22*a* is rotatably supported on the support board 20. On the other hand, in the middle of the tape core 41 (22), a mounting hole 41*a* having a tooth profile engaging portion of serration or spline is provided, and this mounting hole 41*a* is engaged with a rotary shaft portion 46*a* of a take-up rotary gear 46 of the tape interlock unit D mentioned later detachably and integrally in the rotating direction.

As the coat film transfer tape T, for example, on one side of a plastic tape of polyester or acetate, or paper tape or film base material (about 25 to 38 microns in thickness), a peeling layer of vinyl chloride-vinyl acetate copolymer, lower molecular polyethylene or other is formed, and a white corrective paint layer is formed thereon, and further a layer of adhesive such as polyurethane (pressure sensitive adhesive) having a pressure adhesion is laminated (specific structure is not shown). As the corrective paint layer, the so-called dry type is used so as to be able to write over immediately after transfer.

Thus, the coat film transfer tape T propelled from the feed reel 3 is guided, as shown in FIG. 5, into the leading end pressurizing portion 35 along the one-side tape running surface of the coat film transfer head H, and is inverted after the leading end pressurizing portion 35, and is further guided along the opposite-side tape running surface to be taken up on the take-up reel 4.

In this case, the leading end pressurizing portion 35 of the coat film transfer head H collaborates with the tape running surface of the head side surface, and guides the coat film transfer tape T, nearly opposite to the gripping surfaces 2*a*, 2*b* of the case 2, so that the face and back sides of the coat film transfer tape T may face nearly in the same direction (parallel) to the gripping surfaces 2*a*, 2*b*.

Relating to the configuration of the coat film transfer head H and the both reels 11, 12, a pair of guide pins 47, 48 are provided between the two. These guide pins 47, 48 function as the tape position inverting means when inverting the running position of the coat film transfer tape T.

One guide pin 47 is to guide the coat film transfer tape propelled from the feed reel 3 into the coat film transfer head H by inverting the position. The guide pin 47 is provided upright and integrally at the inner side of the case main body 5 between the feed reel 3 and coat film transfer head H. The other guide pin 48 is for guiding the used coat film transfer tape T' from the coat film transfer head H into the take-up reel 4 by inverting the position. The guide pin 48 is provided upright and integrally in a proper position at the back side of the support board 20 between the coat film transfer head H and the take-up reel 4.

In the illustrated embodiment, due to the relation with the shape and dimensions of the support board 20, the guide pin 47 is provided in the case body 5, but it may be also provided at the back side of the support board 20. Thus, in the structure in which the both guide pins 47, 48 are provided on the support board 20, all setting of the tape T is complete in the stage of the product, and the general user has only to replace the tape cartridge C.

Moreover, a flanged roller 49 is rotatably supported on the take-up side guide pin 48. In such constitution, smooth and neat take-up guiding of the coat film transfer tape T' is encouraged, if the coat film is left over on the coat film transfer tape T', it securely prevents inconvenience of inclusion of such coat film transfer tape T' into the guide pin 48. A similar guide roller may be also provided in the feed side guide pin 47.

III. Tape Interlock Unit D

The tape interlock unit (interlock mechanism) D is to interlock the feed reel 3 and take-up reel 4 with each other. More specifically, the tape interlock unit (interlock mechanism) D is composed of a feed rotary gear 45 (interlock gear) provided at the feed reel 3 side, and a take-up rotary gear 46 (interlock gear) provided at the take-up reel 4 side.

The feed rotary gear 45 is formed integrally with a rotary drive unit 51 of a clutch mechanism 50 provided in the feed reel 3, and the rotary drive unit 51 serves also as the rotary shaft of the feed rotary gear 45. The rotary drive unit 51 has a hollow cylindrical shape, and is supported on the rotary support shaft 11 of the case main body 5 detachably and rotatably. In this case, the axial lower end of the rotary drive unit 51 is oscillatably supported on the inner side of the case main body 5 as shown in FIG. 2. Reference numeral 52 is an annular rib provided at the inner side of the case main body 5, and this annular rib 52 is disposed corresponding to the outer circumference of the feed rotary shaft 45, being concentric with the rotary support shaft 11, and prevents excessive distortion of the feed rotary gear 45 by oscillatably supporting the lower side of the feed rotary gear 45.

On the outer circumference of the rotary shaft 51, the tape core 40 of the feed reel 3 is supported coaxially and rotatably. The tape core 40 and the feed rotary gear 45 are frictionally engaged with each other by means of engaging protrusions 70, 70, . . . as frictional engaging members of the clutch mechanism 50 as described below.

The take-up rotary gear 46 is rotatably supported on the rotary support shaft 12 of the case main body 5 for supporting the take-up reel 4, and is engaged with the feed rotary shaft 45 combined with the feed reel 3 as a unit on the support board 20. At the leading end of the rotary support shaft 12, a locking piece 12*a* is provided to prevent the take-up rotary shaft 46 from slipping out.

On the inner circumference of the case main body 5, an annular rib 53 is disposed concentrically with the rotary support shaft 12, corresponding to the take-up rotary gear 46. The take-up rotary gear 46 is supported on this annular rib 53 oscillatably and rotatably.

The take-up rotary gear 46 is engaged with the feed rotary gear 45 with a specified gear ratio. As a result, the take-up rotary gear 46 rotates in collaboration with the feed rotary gear 45 always with a specific rotation ratio. This rotation ratio, that is, the gear ratio of the both gears 45, 46 is set appropriately so that the coat film transfer tape T may be propelled and taken up smoothly, in consideration of the winding diameter of the coat film transfer tape T at the feed reel 3 and take-up reel 4 as described below.

Figure 8:
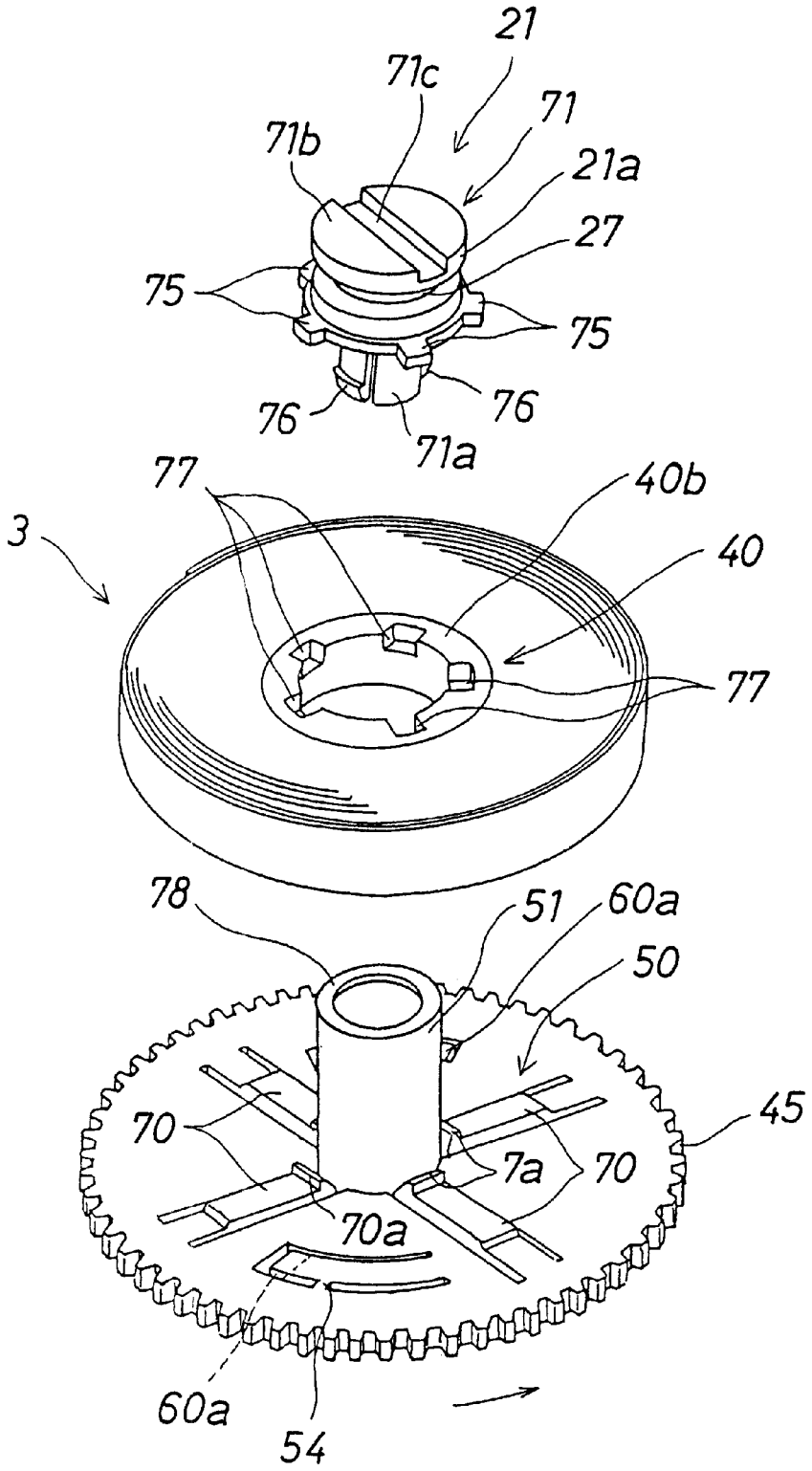
FIG. 8 is a perspective exploded view of the feed reel side position.

In relation thereto, a reverse rotation preventive mechanism 60 for preventing reverse rotation of the reels 3, 4 is provided in the feed rotary gear 45 of the tape cartridge C and the case main body 5. This reverse rotation preventive mechanism 60 is composed of a pair of stopping claws 60*a*, 60*a* provided elastically deformably on the feed rotary gear 45, and multiple reverse rotation preventive claws 60*b*, 60*b*, . . . provided concentrically with the rotary support shaft 11 annularly at the inner side of the case main body 5. As shown in FIG. 8, the position near the leading end of the stopping claw 60*a* is connected and supported to the main body portion of the feed rotary gear 45 through a thin connection piece 54 for reinforcement.

In this constitution, when the both reels 3, 4 rotate in the arrow direction, the stopping claw 60*a* rides over the reverse rotation preventive claws 60*b*, 60*b*, . . . while deforming elastically, and allows the normal rotation. On the other hand, when the reels 3, 4 are caused to rotate in the opposite direction of the arrow direction, the stopping claw 60*a* is engaged with anyone of the reverse rotation preventive claws 60*b*, 60*b*, . . . , and arrests reverse rotation.

Incidentally, this reverse rotation preventive mechanism 60 may be provided at the take-up reel 4 side, and in this case it may be disposed between the case main body 5 and take-up reel 4, or between the support board 20 and the take-up reel 4.

IV. Clutch Mechanism 50

The clutch mechanism 50 is designed to synchronize the feed speed and take-up speed of the coat film transfer tape T at the feed reel 3 and take-up reel 4, and it is provided at the feed reel 3 side.

The clutch mechanism 50 of the embodiment is assembled as a unit in the tape cartridge C together with the feed reel 3 and the feed rotary gear 45 of the tape interlock unit D, and, like the coat film transfer tape T, it is a consumable part to be replaced. For this purpose, the structure of the clutch mechanism 50 is simple and inexpensive as described below.

Figure 7:
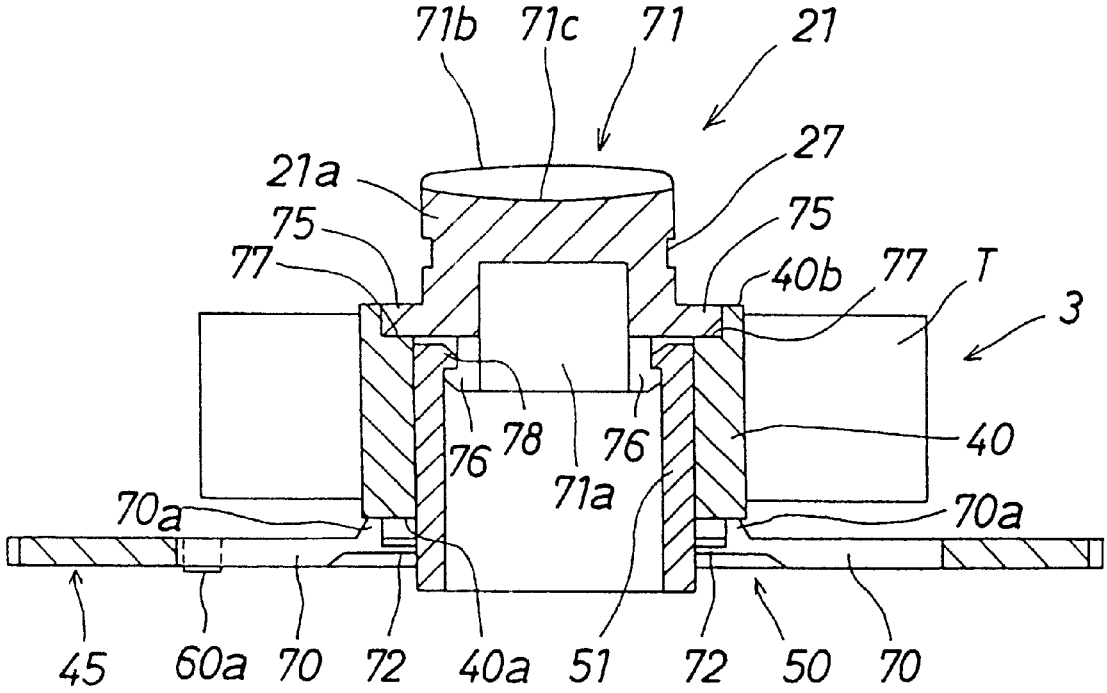
FIG. 7 is a front sectional view showing a feed reel side position of the tape cartridge.
Figure 9:
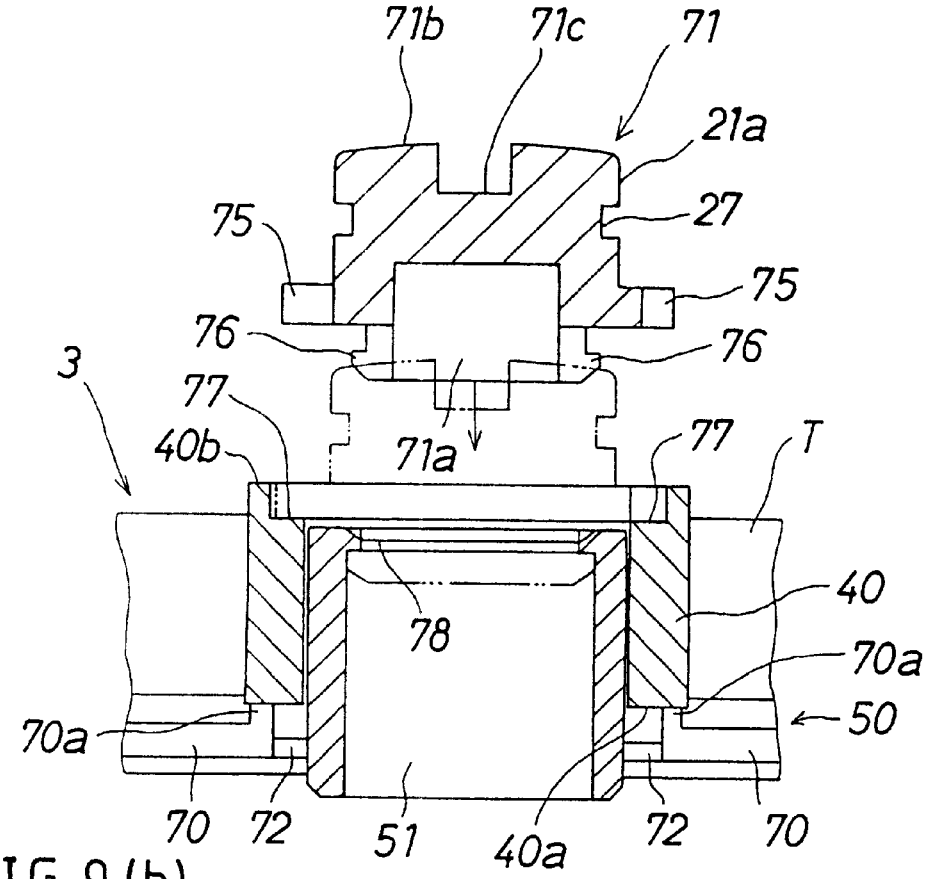
FIGS. 9(*a*) and 9(*b*) are front sectional views explaining the assembling procedure of the feed reel side position.
Figure 9:
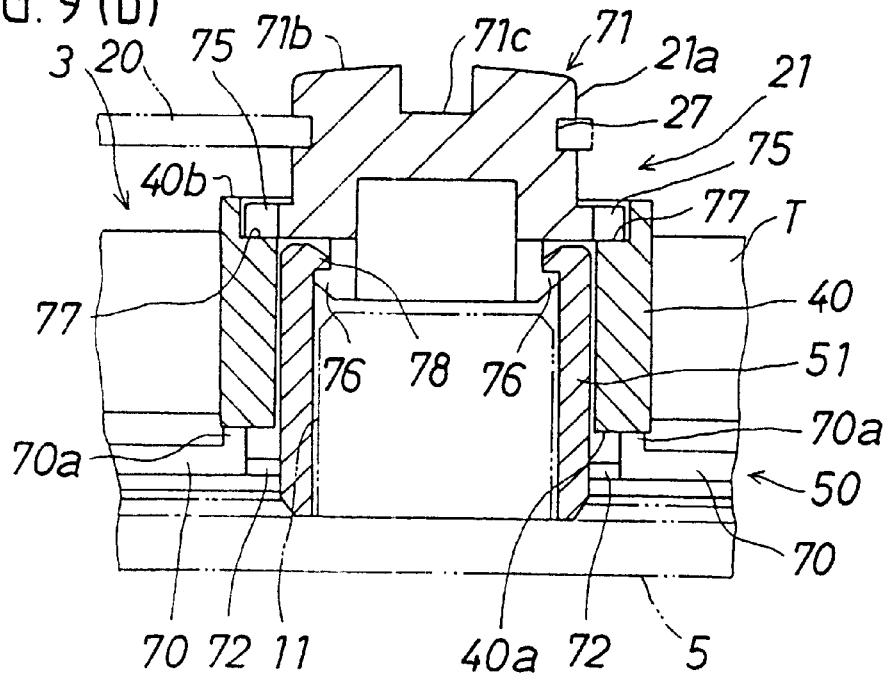

That is, the specific structure of the clutch mechanism 50 is shown in FIG. 7 or FIG. 9, and is mainly composed of plural engaging protrusions 70, 70, . . . formed integrally on the feed rotary gear 45, and an engaging support member 71.

The engaging protrusions 70 are formed as frictional engaging members for composing the power transmission means in the clutch mechanism 50, and are formed integrally, extending to the inner side in the radial direction, at plural positions in the circumferential direction of the feed rotary gear 45 (four positions in the illustrated example). The engaging protrusions 70 can be deformed elastically in the axial direction from the base point of the outer circumferential side, and have engaging portions 70*a* bulging upward at the leading end of the inner circumferential side. In the illustrated embodiment, the inner side leading end of the engaging protrusion 70 is connected and supported integrally to the rotary drive unit 51 through the thin connection piece 72 for reinforcement.

The engaging portion 70*a* of the engaging protrusion 70 is disposed so as to project upward from the upper surface of the feed rotary gear 45 in ordinary state, at a position confronting the axial end face 40*a* of the tape core 40, and has a engaging flat plane corresponding to the flat plane of the axial end face 40*a*.

The engaging support member 71 is specifically in a form of rewind button, and also functions as a constituent member of tape rewinding mechanism for canceling and clearing slack of the coat film transfer tape T between the both reels 3 and 4.

This rewind button 71 has an axial engaging portion 75 to be engaged with the axial end face 40*b* of the tape core 40, and a stopping claw 76 to be engaged with the rotary drive unit 51.

The axial engaging portion 75 is in a form of engaging bump projecting horizontally in the radial direction from the outer circumference of the rewind button 71, and also functions as the rotary engaging portion of the tape rewind mechanism, and in the illustrated example, five pieces are provided at equal intervals in the circumferential direction. By correspondence, the axial end face 40*b* of the tape core 40 is provided with five engaging recesses 77 to be engaged with the axial engaging portions 75 at equal intervals in the circumferential direction.

The stopping claw 76 a has a vertical slit in part of the mounting cylindrical portion 71*a* of the rewind button 71, and its leading end engaging portion is elastically deformable in the radial direction. In the illustrated example, a pair of stopping claws 76,76 are disposed oppositely on a diameter line of the mounting cylindrical portion 71*a*, and the leading end engaging portion of the stopping claw 76 is formed in a downward edge shape.

In correspondence, engaging flanges 78 to be engaged with the stopping claws 76 in the axial direction are provided on the inner circumference of the rotary drive unit 51. The inside diameter of the engaging flanges 78 is set in such a dimension that the mounting cylindrical portion 71*a* of the rewind button 71 may be inserted and the engaging leading end of the stopping pawl 76 may not slip out.

Therefore, after inserting the tape core 40 of the feed reel 3 into the rotary drive unit 51, the rewind button 71 is inserted into the rotary drive unit 51 of the feed rotary gear 45 so that its axial engaging portions 75, 75, . . . may correspond to the engaging recesses 77, 77, . . . of the tape core 40. As a result, the stopping claws 76, 76 of the rewind button 71 correspond to the engaging flanges 78 of the rotary drive unit 51, and are elastically deformed inward in the radial direction to pass in the axial direction, and by their elastic restoration, they are stopped and fixed in the engaging flanges 78 (see FIG. 9 (*a*) to FIG. 9 (*b*)).

Consequently, the tape core 40 is held and supported from both sides in the axial direction by the engaging protrusions 70, 70, . . . of the feed rotary gear 45 and the axial engaging potions 75, 75, . . . of the rewind button 71, and at the same time by the axial engaging force of the rotary drive unit 51 and rewind button 71, the engaging protrusions 70, 70, . . . of the feed rotary gear 45 are elastically engaged with the axial end face 40*a* of the tape core 40 frictionally in the rotating direction with a specified pressing force.

That is, the power transmission of the clutch mechanism 50 is to make use of the frictional engaging force by the thrust load acting between the axial end face 40*a* of the tape core 40 and the engaging protrusions 70, 70, . . . of the feed rotary gear 45, and this frictional engaging force is set at an appropriate value by properly adjusting the engaging dimensional relation in the axial direction between the rotary drive unit 51 and rewind button 71.

More specifically, in consideration of the spring constant of the engaging protrusions 70, 70, . . . of the feed rotary gear 45 and the elastic deformation amount, the relative axial positional relation of the tape core 40 and feed rotary gear 45 is properly adjusted by the axial engaging portion 75 and stopping claw 76 of the rewind button 71, and the frictional engaging force of the engaging protrusions 70, 70, . . . and the axial end face 40a of the tape core 40 is set to an optimum value.

When assembling the tape cartridge C, in the first place, thus constituted unit parts (FIG. 8) of feed reel 3, feed rotary gear 45, and rewind button 71 are integrally assembled in the axial direction to combine into a unit as shown in FIG. 7 and FIG. 9. In succession, these unit assemblies 3, 45, 71 and the take-up reel 4 are mounted on the bearings 25, 26 of the support board 20 in the procedure mentioned above. Finally, the coat film transfer tape T propelled from the feed reel 3 is set along the periphery of the coat film transfer head H, and the leading end is wound around the take-up reel 4, so that the tape cartridge C is completed.

Figure 10:
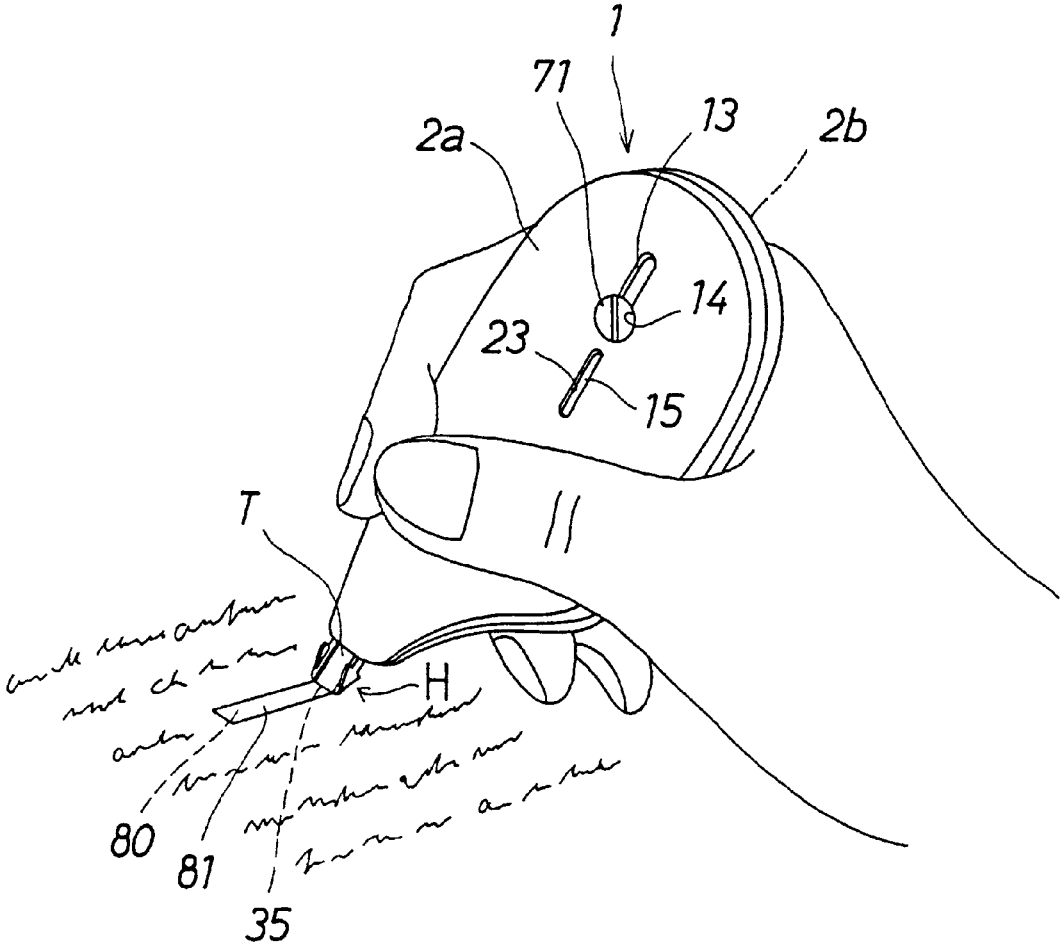
FIG. 10 is a perspective view showing the state of use of the eraser.

The rewind button 71 is set as shown in FIG. 1, FIG. 2 and FIG. 10, so as to be opposite to the outside of the case 2 through the opening 14 formed in the cap body 6 of the case 2, and flush with or lower than the surface of the case 2, that is, the gripping surface 2*a* (see FIG. 2). At the outer end face of the rewind button 71, that is, at the outer surface 71*b*, a linear operation groove 71*c* is formed as a rotation manipulation unit for rotary operation for rewinding, and a coin or other plate operation member can be engaged in this operation groove 71*c*.

Thus, referring to FIG. 2 through FIG. 5, in the tape cartridge C assembled in this manner, by pinching the handling knob 23 by fingers, the feed rotary gear 45 is engaged with the take-up rotary gear 46 mounted on the rotary support shaft 12 of the case main body 5, and the rotary shaft 51 of the feed rotary gear 45 and the tape core 41 of the take-up reel 4 are respectively engaged with the rotary support shaft 11 of the case main body 5 and the rotary shaft 46*a* of the take-up rotary gear 46 from the upper side, and at the same time, the coat film transfer head H is positioned and inserted into the insertion groove 10*a* of the case main body 5, so as to be set in place instantly. In this state, the support board 20 cooperates with the rotary support shafts 11, 12, to rotate and support the feed reel 3 and take-up reel 4 on both sides.

On the other hand, by pinching the handling knob 23 of the support board 20 by fingers and directly lifting to the upper side, the feed rotary gear 45, tape core 41, and coat film transfer head H can be dismounted easily and instantly from the rotary support shaft 11, rotary shaft 46*a* of the take-up rotary gear 46, and insertion groove 10*a*, respectively.

As mentioned above, with the tape cartridge C mounted on the case main body 5, by fixing and locking the cap body 6 in the case main body 5 in the above procedure, the coat film transfer tool 1 is completed. In this case, the rewind button 71 and handling knob 23 face the outside through the opening 14 and slit 15 in the cap body 6, and the coat film transfer head H projects outside through the head insertion portion 10. In this case, the engaging relation of the coat film transfer head H, handling knob 23 and case 2 has a positioning action of the support board 20. The handling knob 23 may be omitted for simplifying the structure.

In this case, the leading end pressurizing portion 35 of the coat film transfer head H cooperates with the tape running surface of the head H side as mentioned above, and the coat film transfer tape T is guided nearly opposite to the gripping surfaces 7*a*, 7*b* of the case 7, so that it is possible to use in lateral draw for correcting part of letters written in lateral direction as in alphabet.

That is, when correcting part of alphabetic letters by using thus constituted coat film transfer tool 1, as shown in FIG.

10, the gripping surfaces 2*a*, 2*b* of the case 2 are held by fingers as if holding a writing implement. In this holding position, the leading end pressurizing portion 35 off the coat film transfer head H is tightly pressed to the start end (left end) of the correction area (transfer area) 80 on the sheet of paper for correcting a wrong letter, and the case 2 is directly moved in the lateral direction, that is, in the right direction to the sheet of paper, and is stopped at the terminal end (right end) of the correction area 80.

By this operation, the corrective paint layer (white) 81 of the coat film transfer tape T at the pressurizing portion 35 of the coat film transfer head H is peeled off from the film base material, and is transferred to cover the correction area 80. As a result, the wrong letter is erased, and a correct letter can be immediately written over.

Paying attention to the mechanical operation inside the coat film transfer tool 1, by the pressurizing operation of such coat film transfer head H, when the tensile force (in the direction of arrow A in FIG. 4) applied to the coat film transfer tape T acts on the feed reel 3 as a rotary torque, the feed rotary gear 45 is further rotated through the tape core 40 of the feed reel 3 and the clutch mechanism 50. This torque is applied to the tape interlock unit D to interlock and rotate the take-up rotary gear 46 and the take-up reel 4 which is integral in the rotating direction, thereby automatically taking up the coat film transfer tape T' after use.

In this case, whereas the rotation ratio of the feed rotary gear 45 and take-up rotary gear 46 (corresponding to the gear ratio of the tape interlock unit D) is always constant, the ratio of the outside diameter of the coat film transfer tape T on the feed reel 3 and the outside diameter of the coat film transfer tape T' on the take-up reel 4 changes every time and is not constant. That is, as used repeatedly, the outside diameter of the coat film transfer tape T on the feed reel 3 decreases gradually while the outside diameter of the coat film transfer tape T' on the take-up reel 4 increases gradually to the contrary.

Accordingly, the take-up speed of the take-up reel 4 becomes faster than the feed speed of the feed reel 3 gradually, and the synchronism of the two speeds is broken, and the rotary torque acting on the feed reel 3 gradually increases. Ultimately, the rotary torque overcomes the frictional force of the clutch mechanism 50, and the tape core 40 slips on the feed rotary gear 45, and the rotary torque difference between the two reels 3, 4 is canceled, so that the feed speed is synchronized with the take-up speed, so that smooth running of the coat film transfer tape T is assured.

As mentioned above, since the power transmission in the clutch mechanism 50 makes use of the frictional force by thrust load between the engaging protrusions 70, 70, . . . of the tape core 40 and the feed rotary gear 45, and therefore by properly adjusting the dimensional relation of the constituent members 3, 45, 71 in the thrust direction in the constitution of the clutch mechanism 50, the frictional force may be set at an optimum value.

Incidentally, due to mishandling by the user or the like, if the coat film transfer tape T slacks between the feed reel 3 and take-up reel 4, by rotating the rewind button 71 from the outside of the case 2 into the rewinding direction (rotating in the direction of arrow B in FIG. 4), the slack of the coat film transfer tape T can be cleared.

In this case, the rotary force in the rewinding direction B applied to the rewind button 71 is transmitted directly to the tape core 40 through the rotary engaging portions 75, 75, . . . serving also as axial engaging portions, so that the tape core 40 is rotated in the rewinding direction B. On the other hand, by the reverse rotation preventive force of the reverse rotation preventive mechanism 60 and the slipping action of the clutch mechanism 50, the rotary gears 45, 46 of the tape interlock unit D and also the tape core 41 of the take-up reel 4 are in stopped state. As a result, the slack of the coat film transfer tape T between the both reels 3, 4 is cleared.

By the use of the coat film transfer tool 1, when the coat film transfer tape T wound on the feed reel 3 is completely taken up on the take-up reel 4 as the used tape T', the entire tape cartridge C is replaced with a new tape cartridge, and this replacement job is done in a single step.

That is, as mentioned above, in the tape cartridge C, the support board 20 is constituted to rotatably support the opposite side ends 21*a*, 22*a* of the rotary shafts 21, 22 of the both reels 3, 4 supported on the rotary support shafts 11, 12 of the case 2, and setting of the coat film transfer tape T on the coat film transfer head H has been already completed in the product state.

Therefore, the user has only to grip the support board 20 to engage the rotary shaft 21 (specifically the rotary shaft 51 of the feed rotary gear 45) and rotary shaft 22 (specifically the tape core 41) of the both reels 3, 4 with the rotary support shaft 11 and rotary support shaft 12 (specifically the rotary shaft 46*a* of the take-up rotary gear 46) of the case 2 from the upper side, and push the tape cartridge C into the case 2 while positioning the coat film transfer head H into the leading end specified position of the case 2, that is, into the insertion groove 10*a*, so that the replacement is over.

In the embodiment, since the coat film transfer head H and the flat support board 20 are plastic plates integrally formed by injection molding or the like, and therefore the number of parts in the tape cartridge C as the consumable parts is decreased, the structure is reduced in size and simplified, the product cost is lowered, and moreover the coat film transfer tool 1 itself may be reduced in size.

Embodiment 2

Figure 11:
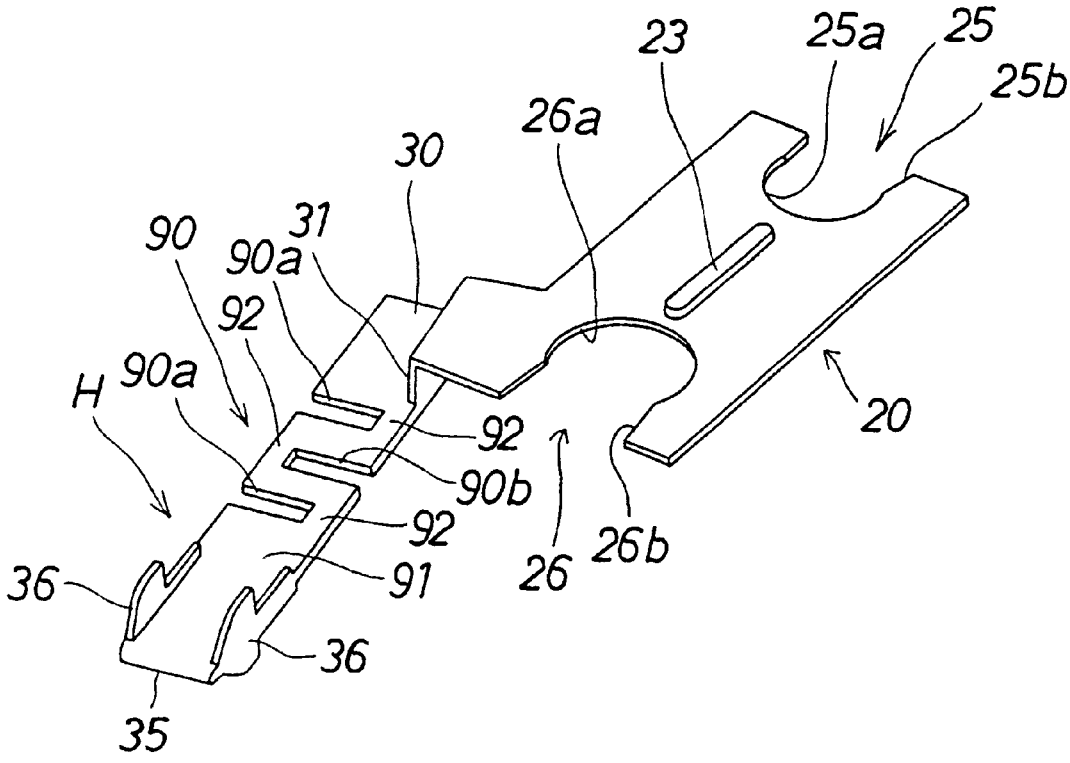
FIG. 11 is a perspective view showing a coat film transfer head and support board of tape cartridge of an eraser in embodiment 2 of the invention.

This embodiment is shown in FIG. 11, in which the specific constitution of the coat film transfer head H is modified.

That is, in the coat film transfer head H of the embodiment, the sectional area of its base end side portion 90 is set smaller than the sectional area of the main body portion 91, and a large elasticity is realized by this base end side portion 90.

More specifically, as shown in the drawing, the base end side portion 90 is formed in a plane zigzag shape as slit notch grooves 90*a*, 90*b* are arranged alternately in opposite directions at specific intervals in the longitudinal direction. As a result, the sectional area of the connection portion 92 of the notch grooves 90*a*, 90*b* in the base end side portion 90 is set much smaller than the sectional area of the main body portion 91, and as a result the coat film transfer head H is provided with a large elasticity by the base end side portion 90, in addition to the original elasticity due to its constituent materials and sectional shape (same elasticity as in embodiment 1).

In thus constituted coat film transfer head H, owing to the presence of this base end side portion 90, as compared with the case of embodiment 1, not only the elastic deformation in the vertical and lateral direction, but also the elastic twisting about the axial line of the head H are reinforced substantially, and the excellent follow-up property of the coat film transfer head H is assured depending on the handling habit of the user or the application. Such head constitution is particularly effective if optimum elasticity required in he head H cannot be obtained because the head H is integrally formed of the material satisfying the required hardness of the support board 20.

The other constitution and action are same as in embodiment 1.

Embodiment 3

Figure 12:
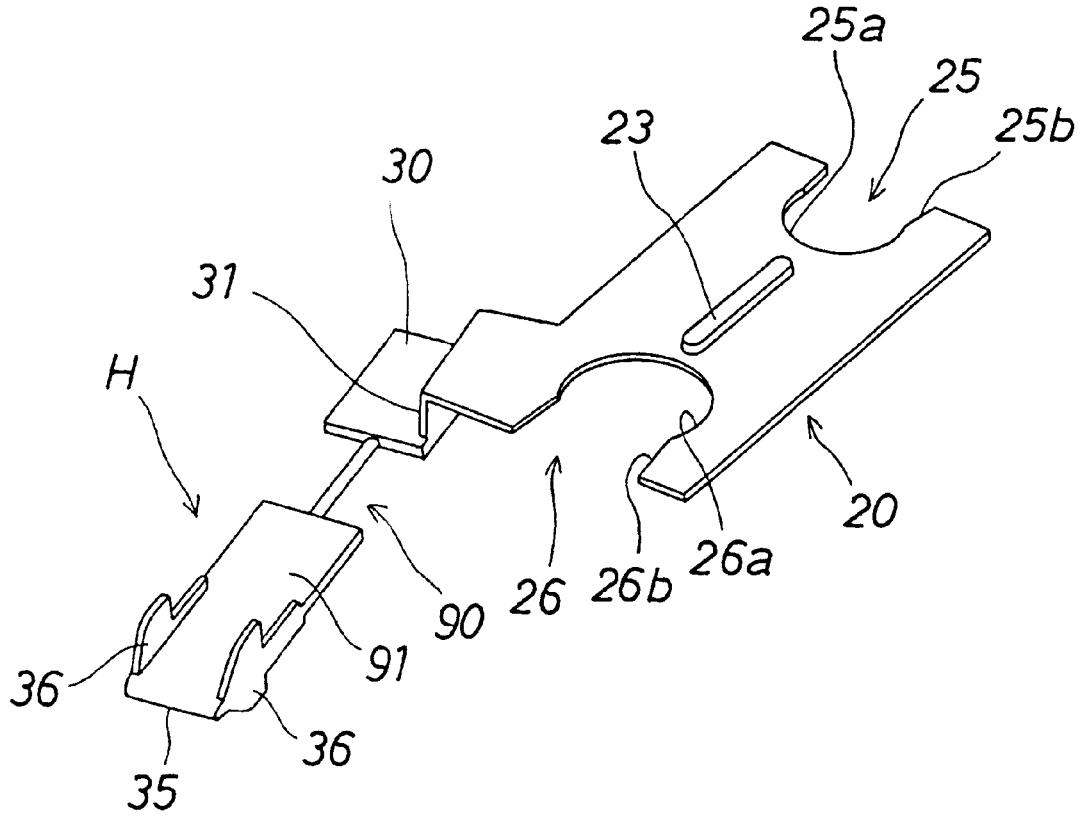
FIG. 12 is a perspective view showing a coat film transfer head and support board of tape cartridge of an eraser in embodiment 3 of the invention.

This embodiment is shown in FIG. 12, in which, same as in embodiment 2, the specific constitution of the coat film transfer head H is modified.

That is, in the coat film transfer head H of the embodiment, too, the sectional area of its base end side portion 90 is set smaller than the sectional area of the main body portion 91, and a large elasticity is realized by this base end side portion 90.

More specifically, as shown in the drawing, the base end side portion 90 is formed as a thin linear bar connecting the main body portion 91 and the base end portion. This linear bar 90 is disposed on the axial line of the coat film transfer head H, and is formed as a column of which section is circular, and diameter is nearly equal to the thickness of the main body portion 91.

In thus constituted coat film transfer head H, in addition to the original elasticity on the basis of its constituent materials and sectional shape, owing to the presence of this base end side portion 90, not only the elastic deformation in the vertical and lateral direction, but also the elastic twisting about the axial line of the head H are reinforced substantially, and a large elasticity is provided.

The other constitution and action are same as in embodiment 2.

Embodiment 4

Figure 13:
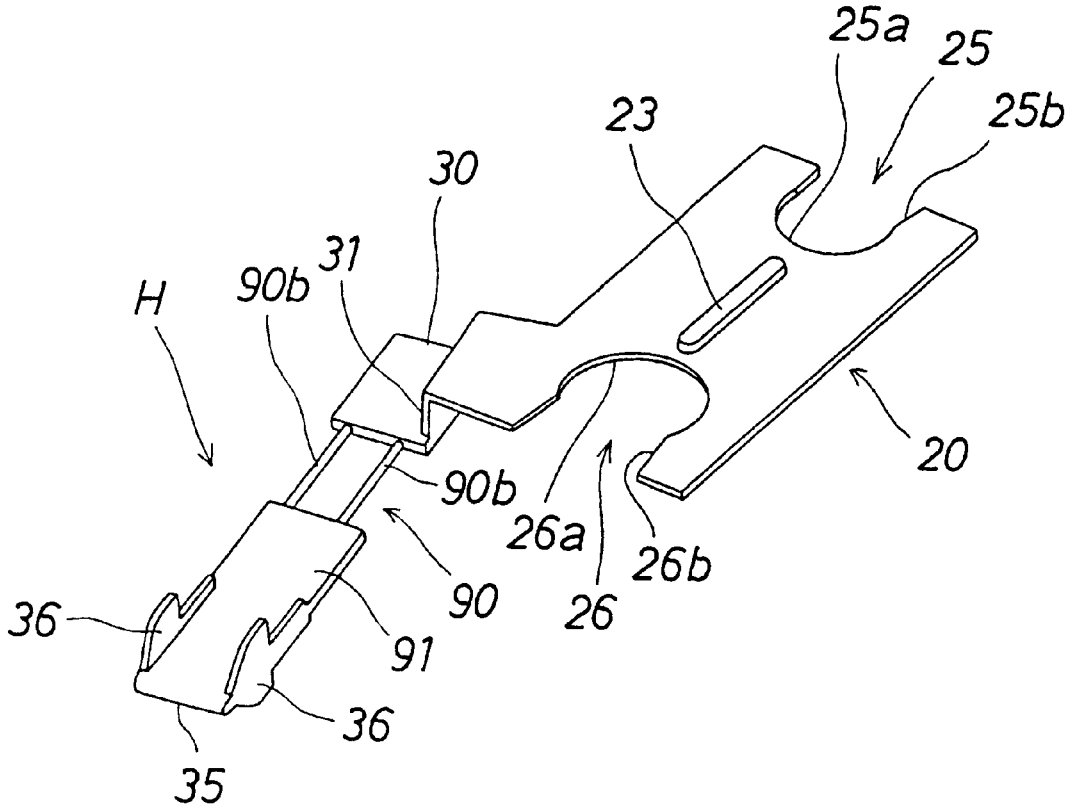
FIG. 13 is a perspective view showing a coat film transfer head and support board of tape cartridge of an eraser in embodiment 4 of the invention.

This embodiment is shown in FIG. 13, in which, same as in embodiment 2, the specific constitution of the coat film transfer head H is modified.

That is, in the coat film transfer head H of the embodiment, too, the sectional area of its base end side portion 90 is set smaller than the sectional area of the main body portion 91, and a large elasticity is realized by this base end side portion 90.

More specifically, as shown in the drawing, the base end side portion 90 is formed as a pair of thin linear bars 90*b*, 90*b* for connecting the main body portion 91 and the base end portion. This linear bar 90*b*, same as in embodiment 3, is formed as a column of which section is circular, and diameter is nearly equal to the thickness of the main body portion 91. The both linear bars 90*b*, 90*b* are parallel to the axial line of the coat film transfer head H and are disposed at an equal distance from this axial line. The other constitution and action are same as in embodiment 3.

Embodiment 5

Figure 14A:
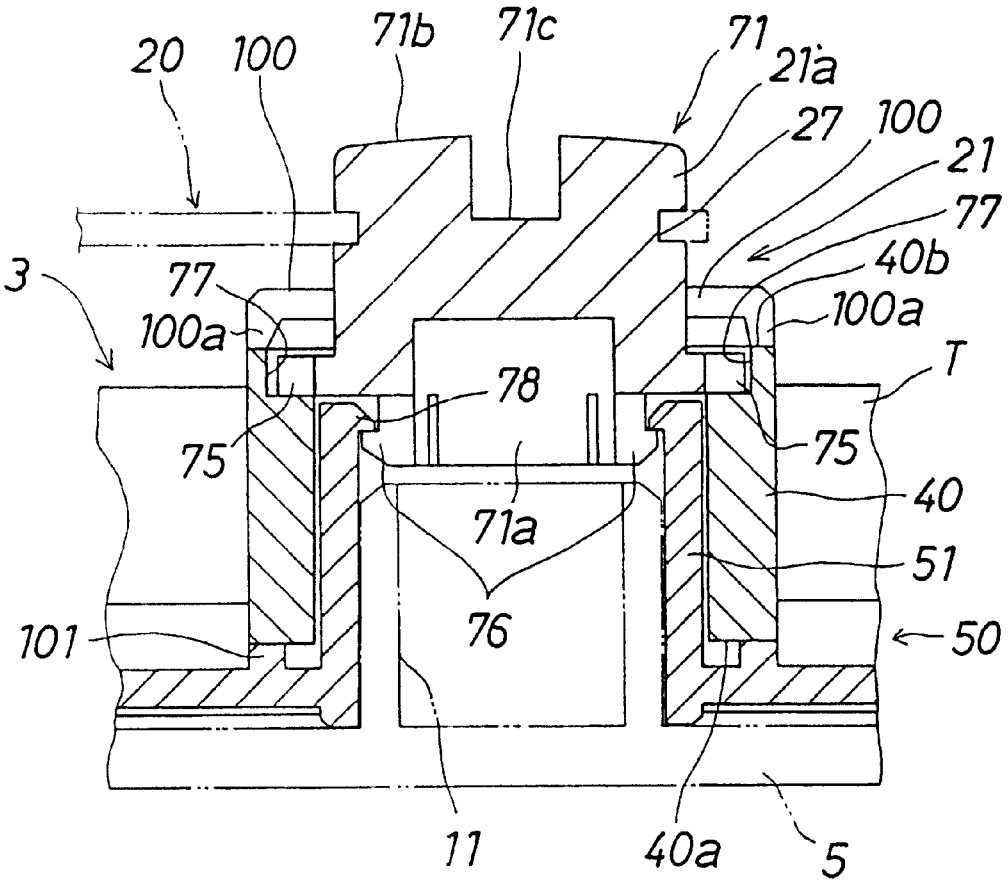
FIG. 14 (*a*) is a front sectional view showing the feed reel side position of principal parts of a tape cartridge of an eraser in embodiment 5 of the invention.
Figure 14B:
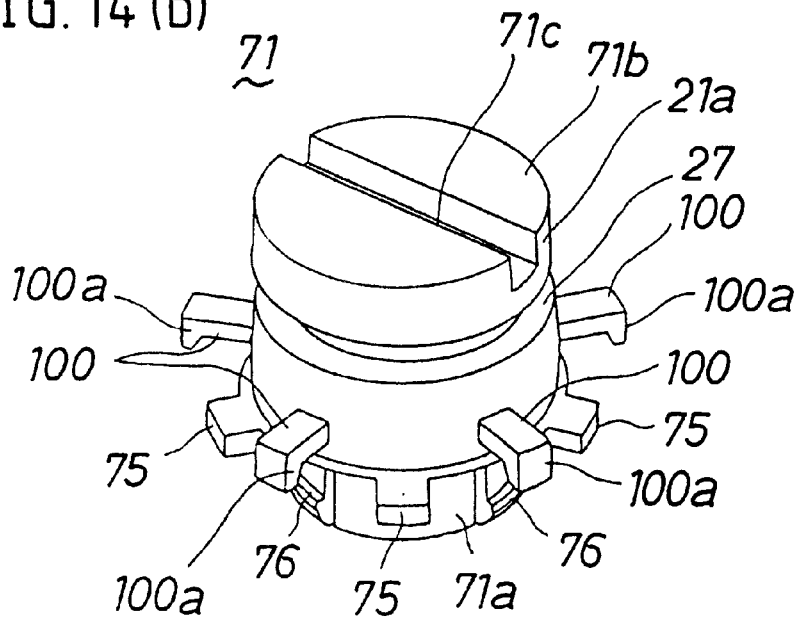

This embodiment is shown in FIG. 14, in which the specific constitution of the clutch mechanism 50 is modified.

That is, in the clutch mechanism 50 of the embodiment, engaging protrusions 100, 100, . . . are provided in the rewind button 71.

More specifically, the engaging protrusions 100 are formed integrally, extending horizontally in the radial direction, at plural positions in the circumferential direction (five positions in the illustrated example) of the rewind button 71. The engaging protrusions 100 are elastically deformable in the axial direction from the base point at the inner circumferential side, and have engaging portions 100*a* swelling downward at the leading end at the outer circumferential side. In the illustrated embodiment, considering the ease of forming of the rewind button 71 by injection molding or the like, the engaging protrusions 100 are positioned uniformly between the axial engaging portions 75, 75.

The engaging portions 100*a* of the engaging protrusions 100 are disposed at the positions facing the axial end face 40*b* of the tape core 40, and have flat planes on the axial end face 40*b*, more specifically, engaging flat planes corresponding to the outer circumferential portions of the engaging recesses 77, 77, . . . .

Corresponding to the constitution of the engaging protrusions 100, 100, . . . , on the upper surface of the feed rotary gear 45, engaging ribs 101 are provided corresponding to the flat outer circumferential portions of the axial end face 40*a* of the tape core 40, so as to support the axial end face 40*a* in a frictional engagement state.

Thus, the stopping claws 76, 76 of the rewind button 71 are engaged with the engaging flanges 78 of the rotary shaft 51 to prevent slipping out, and the tape core 40 is held and supported from both sides in the axial direction by the engaging ribs 101 of the feed rotary gear 45 and the engaging protrusions 100, 100, . . . of the rewind button 71.

Moreover, the engaging protrusions 100, 100, . . . are elastically engaged with the axial end face 40*b* of the tape core 40 frictionally in the rotating direction with a specific pressing force, and the power transmission of the clutch mechanism 6 is same as in the case of embodiment 1, that is, it makes use of the frictional engagement force by the thrust load acting between the axial end face 40*b* of the tape core 40 and the engaging protrusions 100, 100, of the rewind button 71.

In this case, it is same as in embodiment 1 that the frictional engagement force is set by properly adjusting the engagement dimensional relation of the feed rotary gear 45 and rewind button 71 in the axial direction, but in this embodiment, the axial engaging portions 75 of the rewind button 71 function only as rotation engaging portions of the tape rewind mechanism, but do not function as the axial engaging portions. Instead, in this embodiment, the engaging protrusions 100, 100, . . . also have the function of axial engaging portions. Hence, in the engaged state of the stopping claws 76, 76 and engaging flanges 78, the engaging portions 75, 75, . . . are engaged with the engaging recesses 77, 77, . . . of the axial end face 40*b* of the tape core 40 only in the rotating direction, and the dimensional relation is designed so as not to be engaged in the axial direction.

The other constitution and action are same as in embodiment 1.

Embodiment 6

Figure 15:
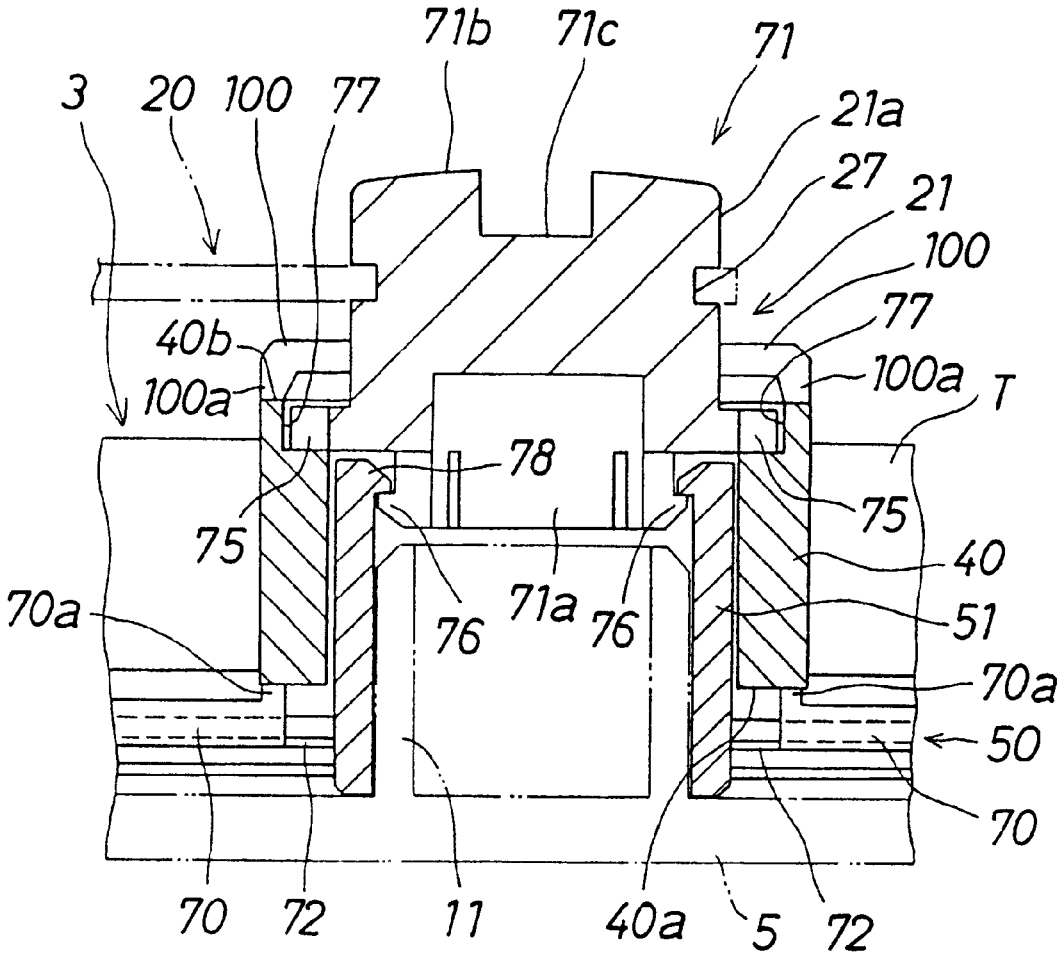
FIG. 15 is a front sectional view showing the feed reel side position of principal parts of a tape cartridge of an eraser in embodiment 6 of the invention.

This embodiment is shown in FIG. 15, in which the specific constitution of the clutch mechanism 50 is modified.

That is, the clutch mechanism 50 of the embodiment is a combination of the constitution of embodiment 1 (FIG. 1 to FIG. 10) and the constitution of embodiment 5 (FIG. 14).

More specifically, engaging protrusions 70, 70, . . . are integrally formed in the feed rotary gear 45, engaging protrusions 100, 100, . . . are integrally formed in the rewind button 71, and the specific constitutions of these engaging protrusions 70, 100 are same as in embodiment 1 and embodiment 2, respectively.

Thus, the stopping claws 76, 76 of the rewind button 71 are engaged with the engaging flanges 78 of the rotary shaft 51 to prevent slipping out, and the tape core 40 is held and supported from both sides in the axial direction by the engaging protrusions 70, 70, . . . of the feed rotary gear 45 and the engaging protrusions 100, 100, . . . of the rewind button 71.

Moreover, the both engaging protrusions 70, 100, . . . are elastically engaged with the both axial end faces 40*a*, 40*b* of the tape core 40 frictionally in the rotating direction with a specific pressing force, and the power transmission of the clutch mechanism 50 is realized by making use of the frictional engagement force acting between the axial end faces 40*a*, 40*b* of the tape core 40 and the engaging protrusions 70, 100, . . . .

The other constitution and action are same as in embodiment 1.

Embodiment 7

Figure 16:
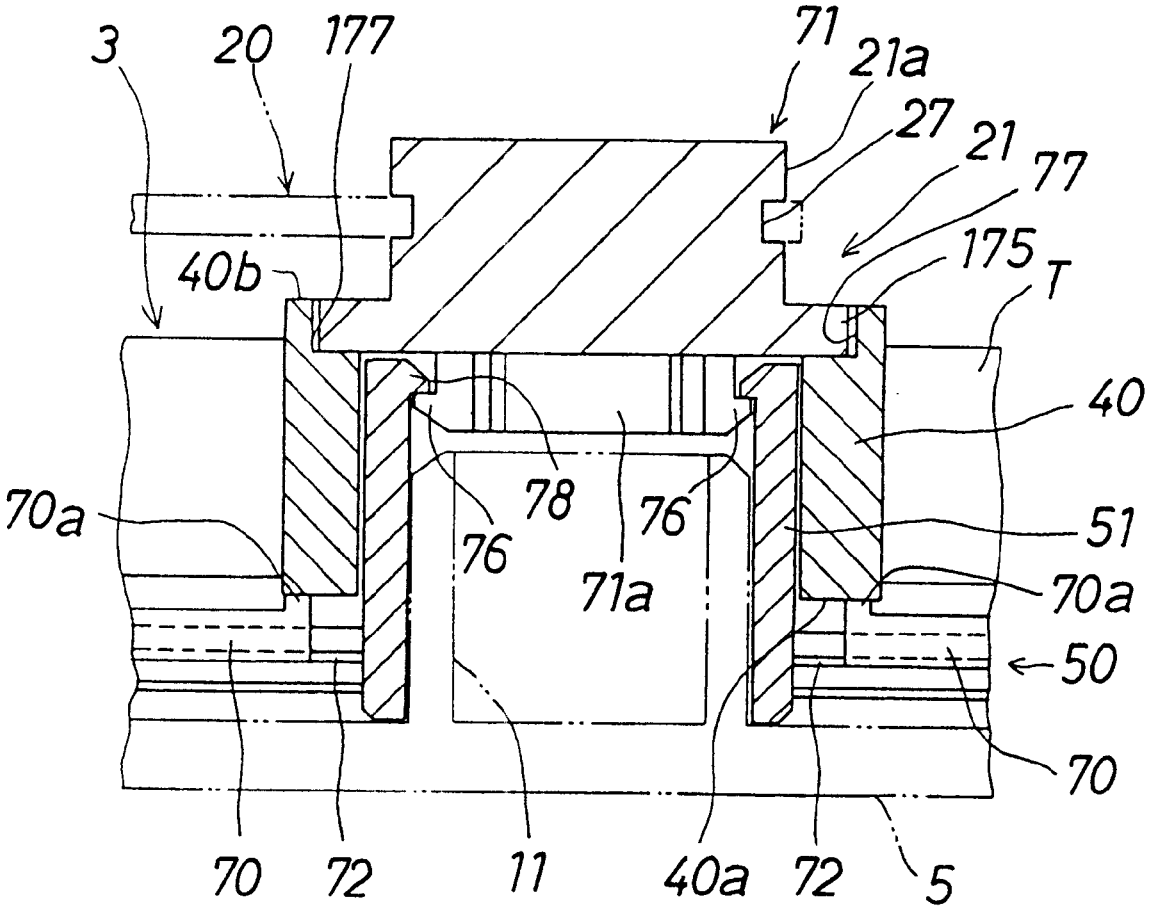
FIG. 16 is a front sectional view showing the feed reel side position of principal parts of a tape cartridge of an eraser in embodiment 7 of the invention.
Figure 17:
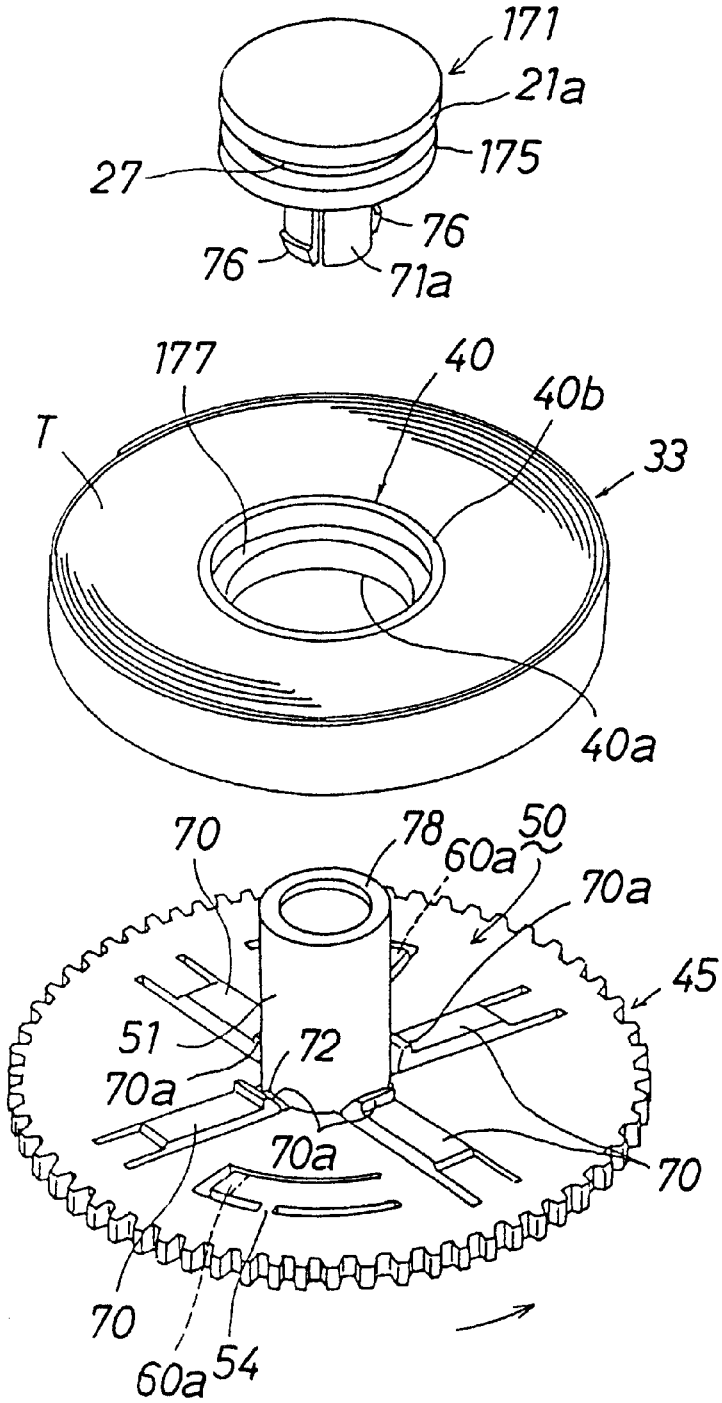
FIG. 17 is a perspective exploded view of the feed reel side position.

This embodiment is shown in FIG. 16 and FIG. 17, in which the specific constitution of the clutch mechanism 50 is modified.

That is, the tape rewinding mechanism is omitted in the constitution of embodiment 1 (FIG. 1 to FIG. 10).

More specifically, in the clutch mechanism 50, an engaging support member 171 is in a shape and dimension to be accommodated inside of the case 7, and an axial engaging portion 175 provided in this engaging support member 171 is in a form of an engaging flange projecting horizontally in the radial direction from the outer circumference of the engaging support member 171 as shown in FIG. 17.

By contrast, an engaging recess 177 is provided at the axial end face 40*b* of the tape core 40, and this engaging recess 177 is formed in an annular recess to be engaged with the outer circumference of the engaging flange 175.

The other constitution and action are same as in embodiment 1.

Embodiment 8

Figure 18A:
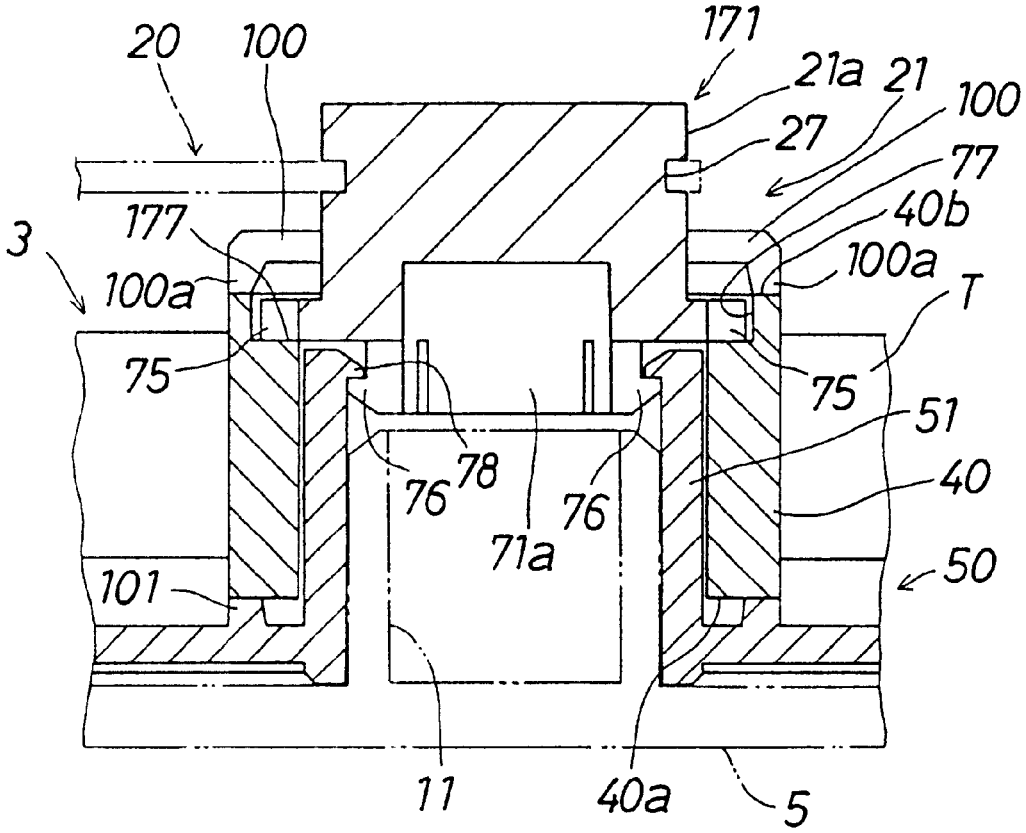
FIG. 18 (*a*) is a front sectional view showing the feed reel side position of principal parts of a tape cartridge of an eraser in embodiment 8 of the invention.
Figure 18B:
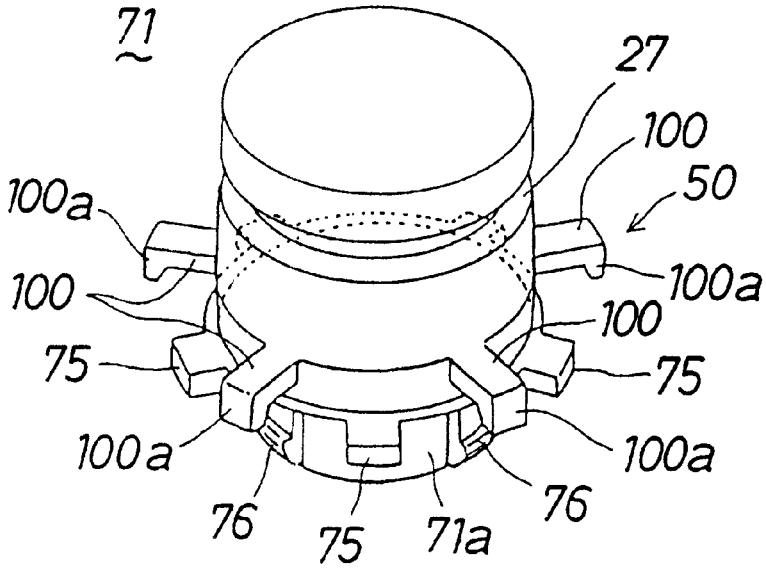

This embodiment is shown in FIG. 18, in which the specific constitution of the clutch mechanism 50 is modified.

That is, same as in embodiment 7, in the clutch mechanism 50 omitting the tape rewinding mechanism, a frictional engaging member is integrally provided in the engaging support member 171.

More specifically, the clutch mechanism 50 of the embodiment is a combination of the constitution of embodiment 7 and the constitution of embodiment 5. In this case, same as in embodiment 5, considering the ease of forming of the engagig support member 171 by injection molding or the like, the engaging protrusions 100 are positioned uniformly between the axial engaging portions 75, 75.

The other constitution and action are same as in embodiment 7.

Embodiment 9

Figure 19:
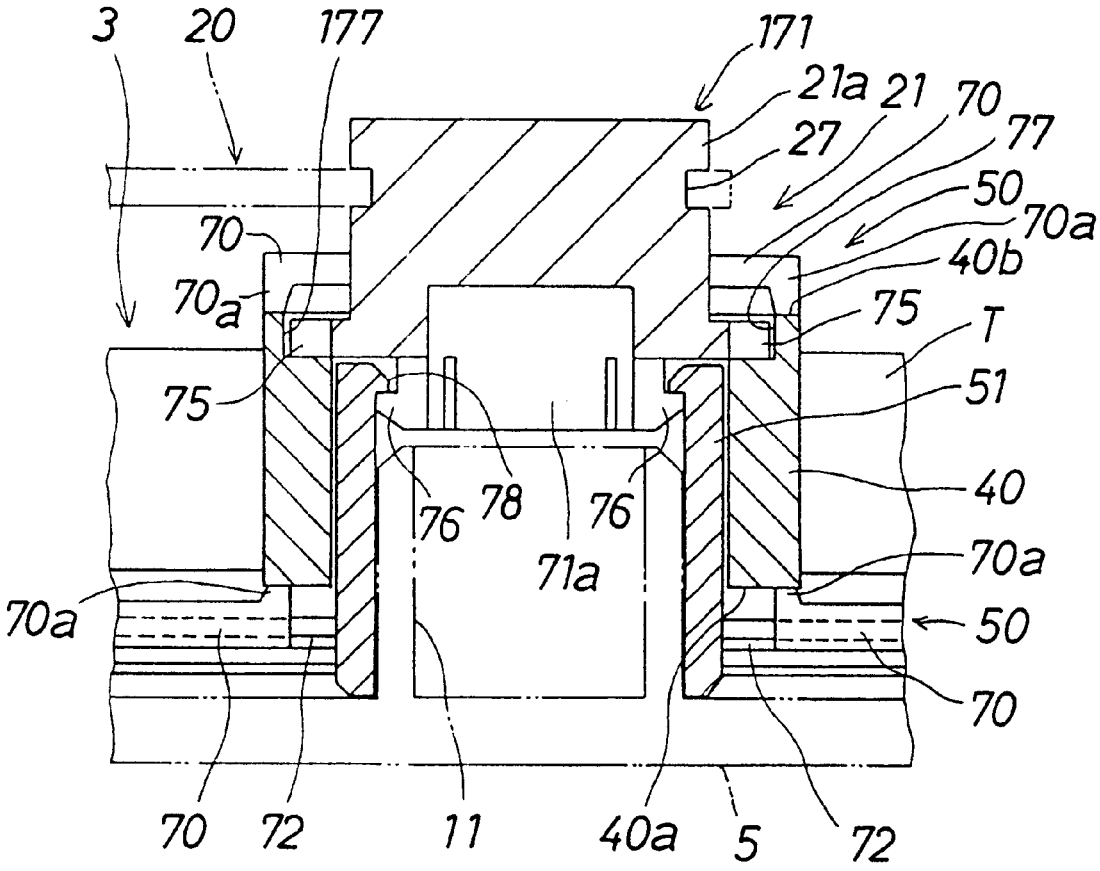
FIG. 19 is a front sectional view showing the feed reel side position of principal parts of a tape cartridge of an eraser in embodiment 9 of the invention.

This embodiment is shown in FIG. 19, in which the specific constitution of the clutch mechanism 50 is modified.

That is, the clutch mechanism 50 of the embodiment is a combination of the constitution of embodiment 1 (FIG. 1 to FIG. 10) and the constitution of embodiment 8 (FIG. 18).

More specifically, engaging protrusions 70, 70, . . . are integrally formed in the feed rotary gear 45, and engaging protrusions 100, 100, . . . are integrally formed in the engaging support member 171, and the specific constitutions of these engaging protrusions 70 and 100 are same as in embodiment 1 and embodiment 8, respectively.

The other constitution and action are same as in embodiment 7.

Embodiment 10

Figure 20:
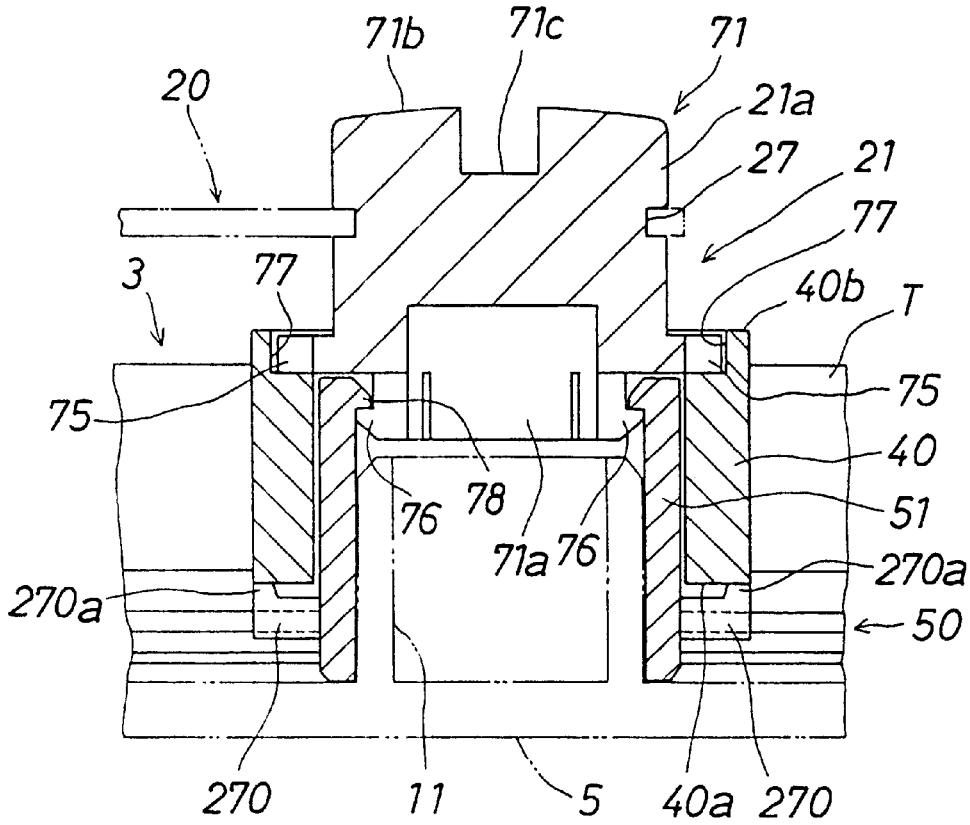
FIG. 20 (*a*) is a front sectional view showing the feed reel side position of principal parts of a tape cartridge of an eraser in embodiment 10 of the invention.
Figure 20:
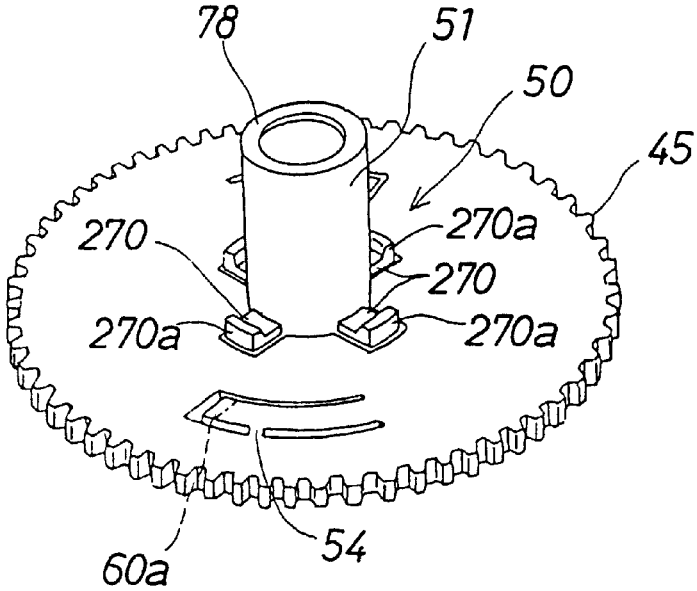
Figure 21A:
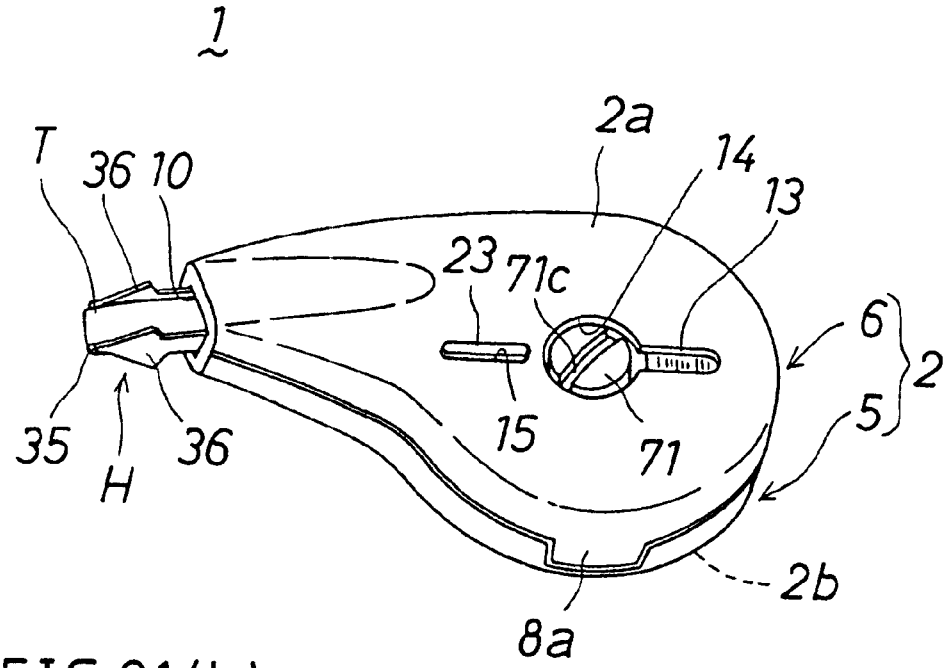
FIG. 21 (*a*) is a perspective view showing an eraser in embodiment 11 of the invention.
Figure 21B:
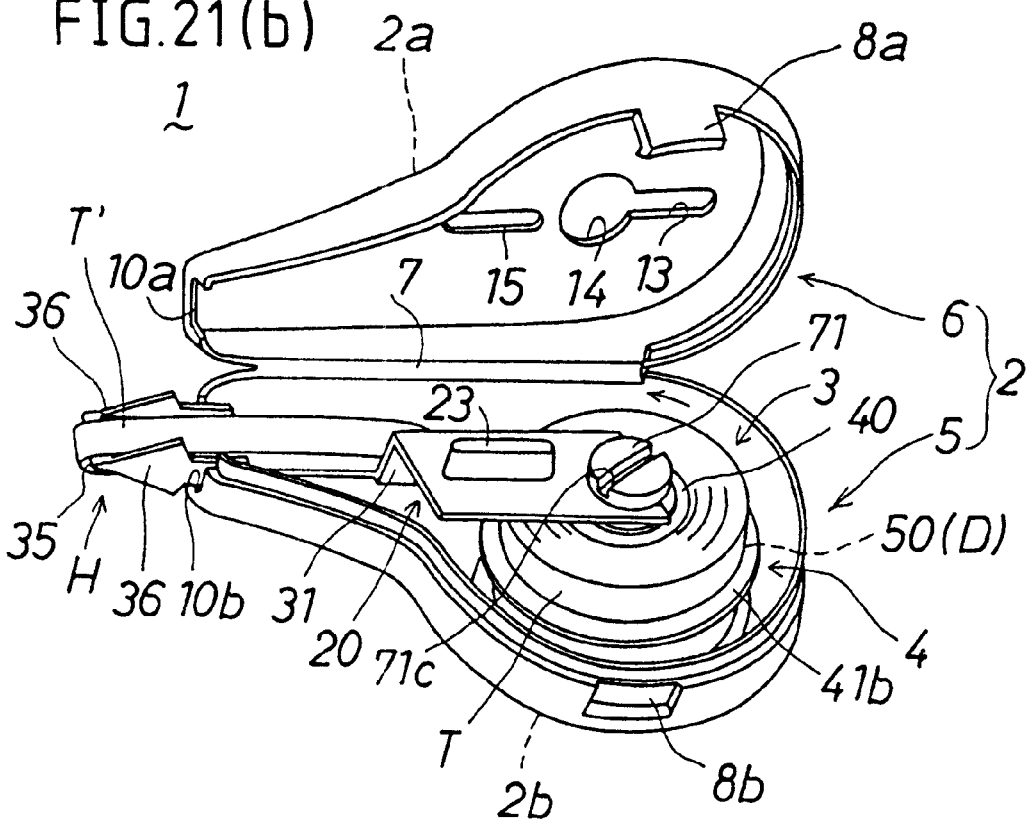
Figure 22:
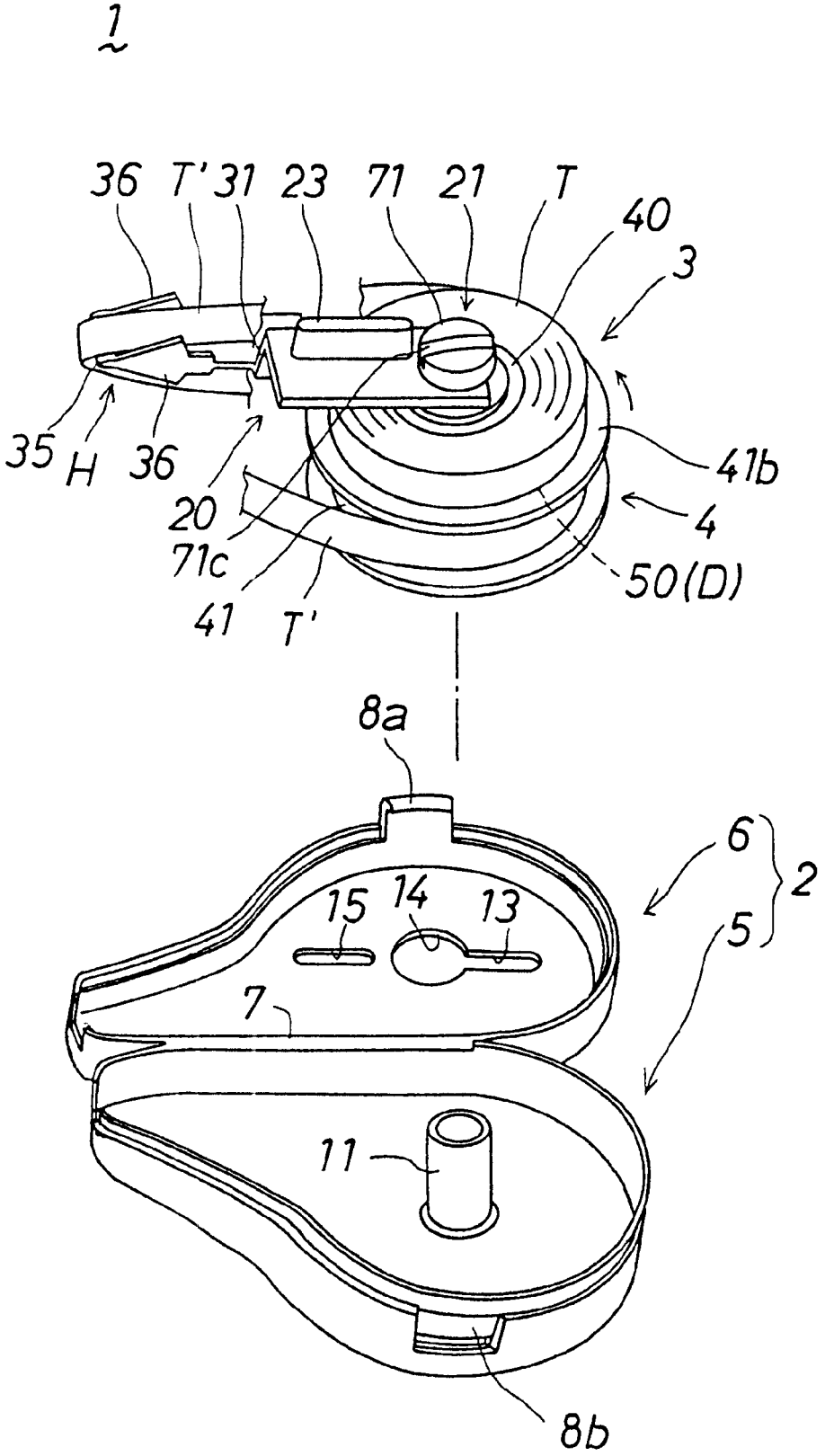
FIG. 22 is a perspective view showing a state of taking out a tape cartridge from the case main body in the eraser.

This embodiment is shown in FIG. 20, in which the specific constitution of the clutch mechanism 50 is modified.

More specifically, engaging protrusions (frictional engaging members) 270, 270, . . . integrally formed in the feed rotary gear 45 are extended outside in the radial direction from the rotary shaft 51 of the feed rotary gear 45, and their engaging portions 270*a*, 270*a*, . . . are frictionally engaged with the axial end face 40*a* of the tape core 40.

The other constitution and action are same as in embodiment 1.

Embodiment 11

This embodiment is shown in FIG. 21 to FIG. 24, and as compared with embodiments 1 to 10 in which the feed reel 3 and take-up reel 4 are independently supported on the support board 20 rotatably to compose a twin-shaft type reel structure, this is a single-shaft type reel structure having the feed reel 3 and take-up reel 4 coaxially supported on the support board 20 in a mutually rotatable state.

Figure 23:
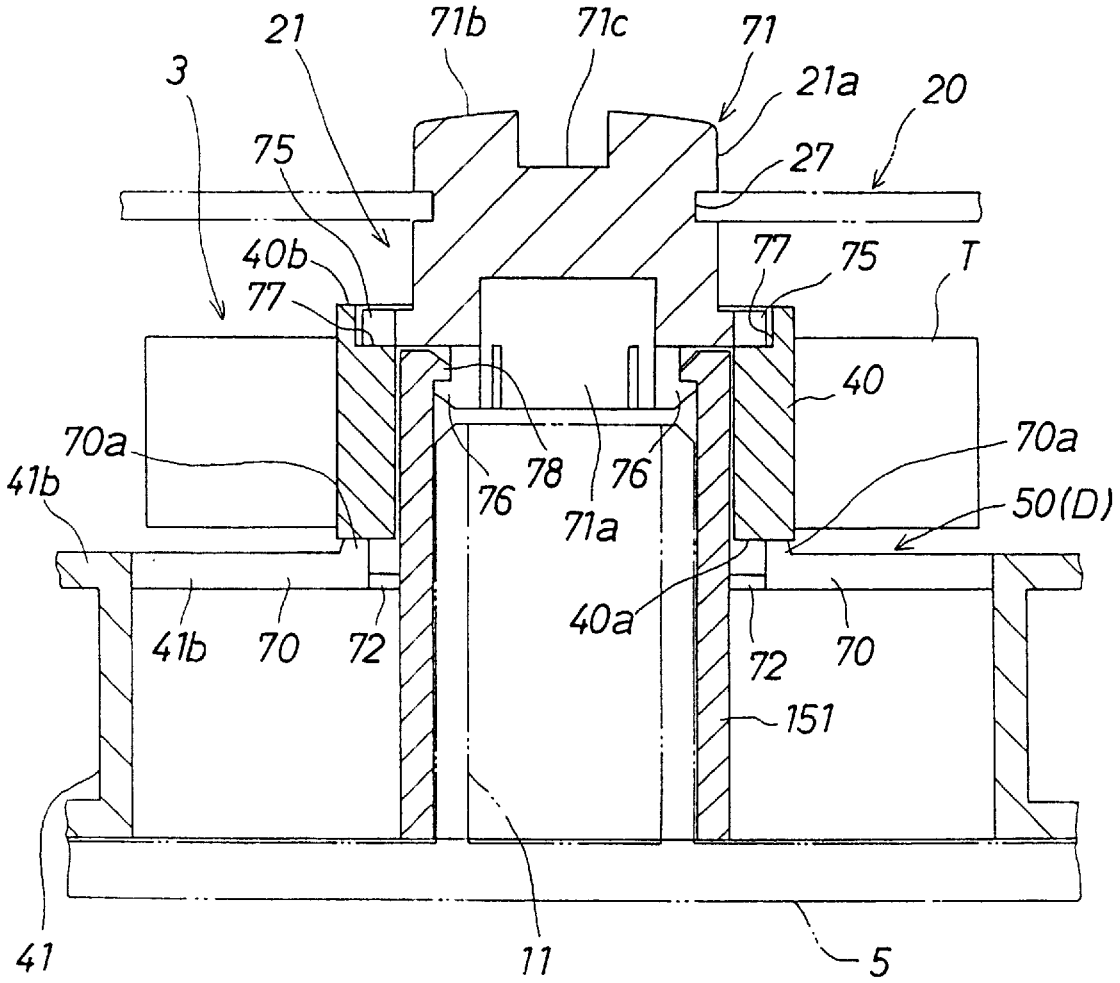
FIG. 23 is a front sectional view showing the position of feed reel and take-up reel of the cartridge in the eraser.
Figure 24:
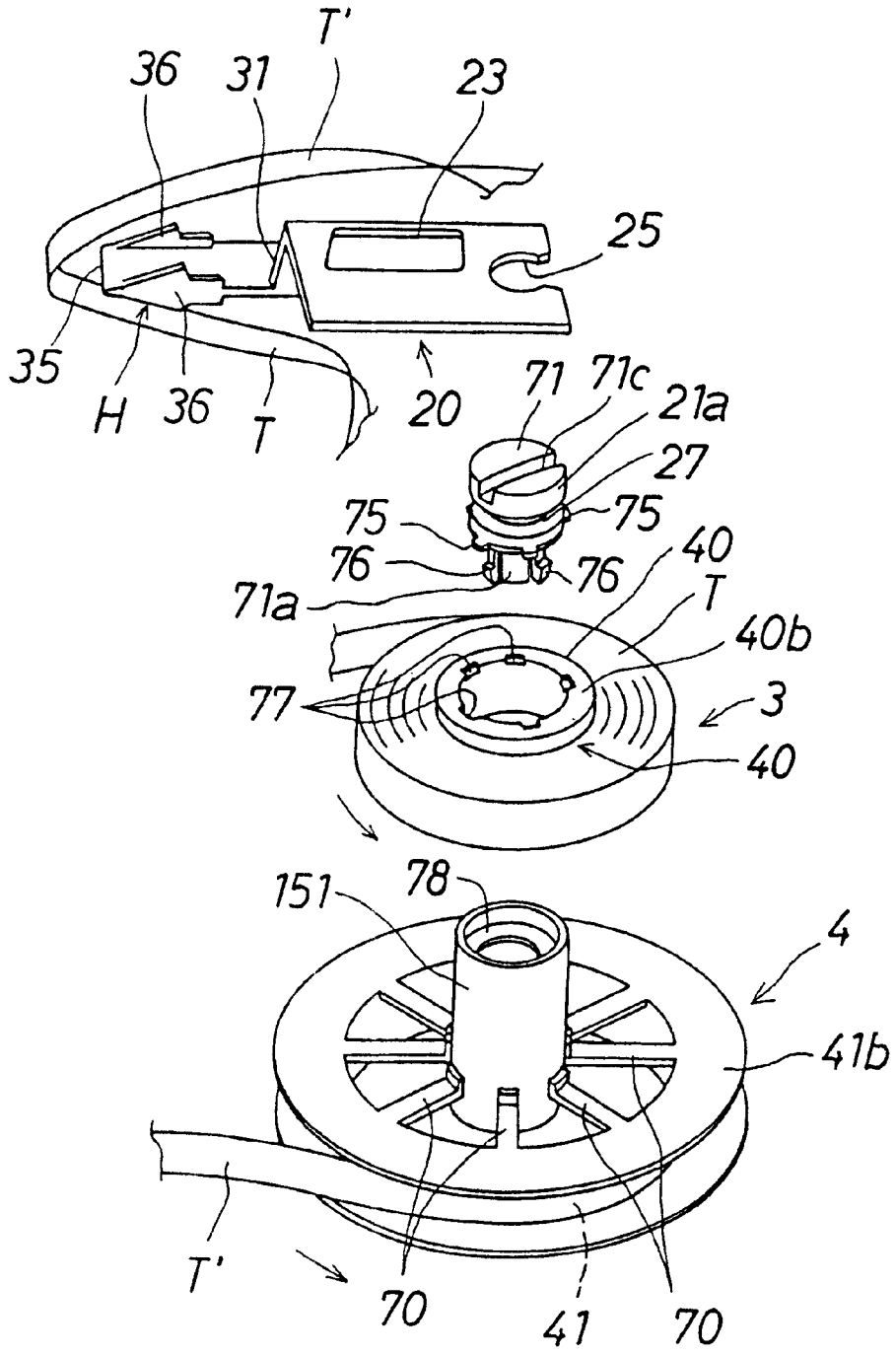
FIG. 24 is a perspective exploded view of a cartridge in the eraser.

In the embodiment, as shown in FIG. 23 and FIG. 24, a rotary shaft (rotary drive unit) 151 disposed inside of the tape core 41 of the take-up reel 4, being projected and extended to the upper side in the axial direction from the upper side tape running guide flange 41*b*, and the tape core 40 of the feed reel 3 is supported on the outer circumference of this rotary shaft 151 coaxially and rotatably, and the tape core 40 and the take-up reel 4 are frictionally engaged with each other by means of engaging protrusions 70, 70, . . . as frictional engaging members of the clutch mechanism 50.

The clutch mechanism 50 composes not only the power transmission means between the reels 3, 4 as the original function same as in the foregoing embodiments, but also the function same as the tape interlock unit (interlock mechanism) D in the foregoing embodiments as the rotary drive unit mutually interlocking the both reels 3, 4.

More specifically, plural engaging protrusions 70, 70, . . . of the clutch mechanism 50 are formed integrally at the inner side of the tape running guide flange 41*b* of the take-up reel 4, and the engaging portion 70*a* is disposed so as to project upward from the upper surface of the tape running guide flange 41*b* in the ordinary state, at the position confronting the axial end face 40*a* of the tape core 40 of the feed reel 3, and has a engaging flat plane corresponding to the flat plane of the axial end face 40*a*.

The rewind button 71 as the engaging support member has its axial engaging portion 75 engaged with an engaging recess 77 of the axial end face 40*b* of the tape core 40, and its stopping claw 76 engaged with the rotary shaft 151 of the take-up reel 4. For this purpose, on the inner circumference of the rotary shaft 151, there is an engaging flange 78 for engaging the stopping claw 76 in the axial direction. The constitution of the stopping claw 76 and engaging flange 78 is same as in the foregoing embodiments.

In the unit of the reels 3, 4 thus assembled by the rewind button 71, the rotary shaft 151 of the take-up reel 4 is supported on the rotary support shaft 11 of the case main body 5 detachably and rotatably. In this case, the action of preventing the both reels 3, 4 from slipping out of the rotary support shaft 11 is achieved by the engaging relation of the coat film transfer head H, support board 20, and the closed case 2.

In the state of the both reels 3, 4 being mounted on the case 2, the coat film transfer tape T propelled from the feed reel 3 is, although not shown specifically, guided through the guide pin 47, and is inverted through the leading end pressurizing portion 35 of the coat film transfer head H, and is further guided through the guide pin 48, and is wound around the take-up reel 4.

The other constitution and action are same as in embodiment 1.

Embodiment 12

Figure 25:
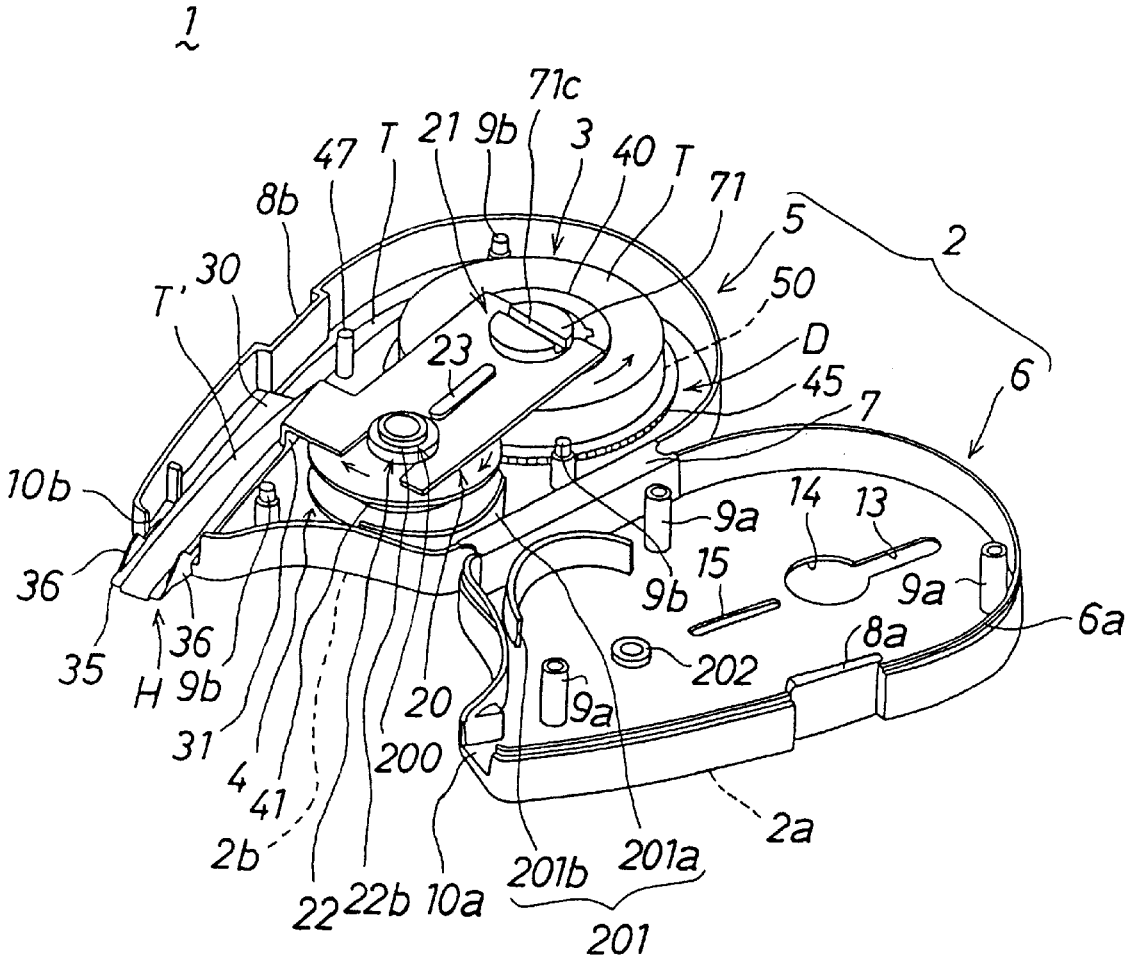
FIG. 25 is a perspective view showing a case opened sate of the inside of an eraser in embodiment 12 of the invention.
Figure 26:
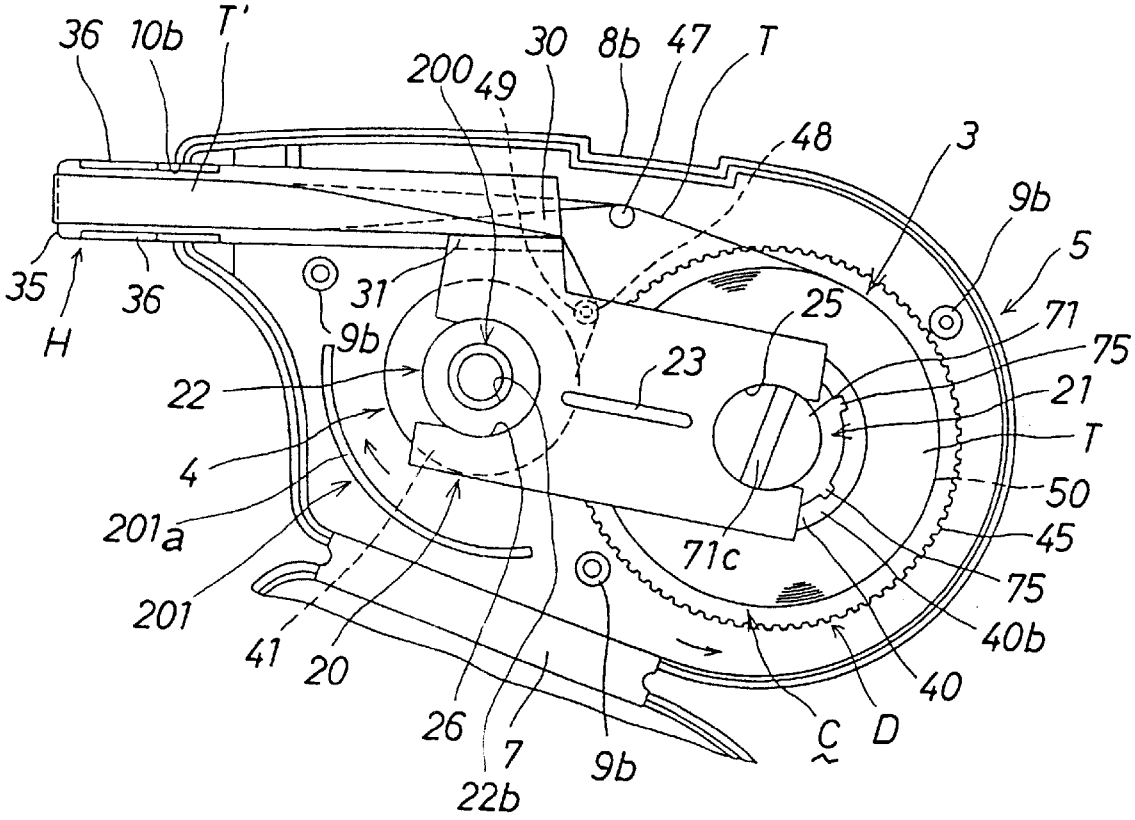
FIG. 26 is a front view showing the inside of the case main body of the eraser
Figure 27:
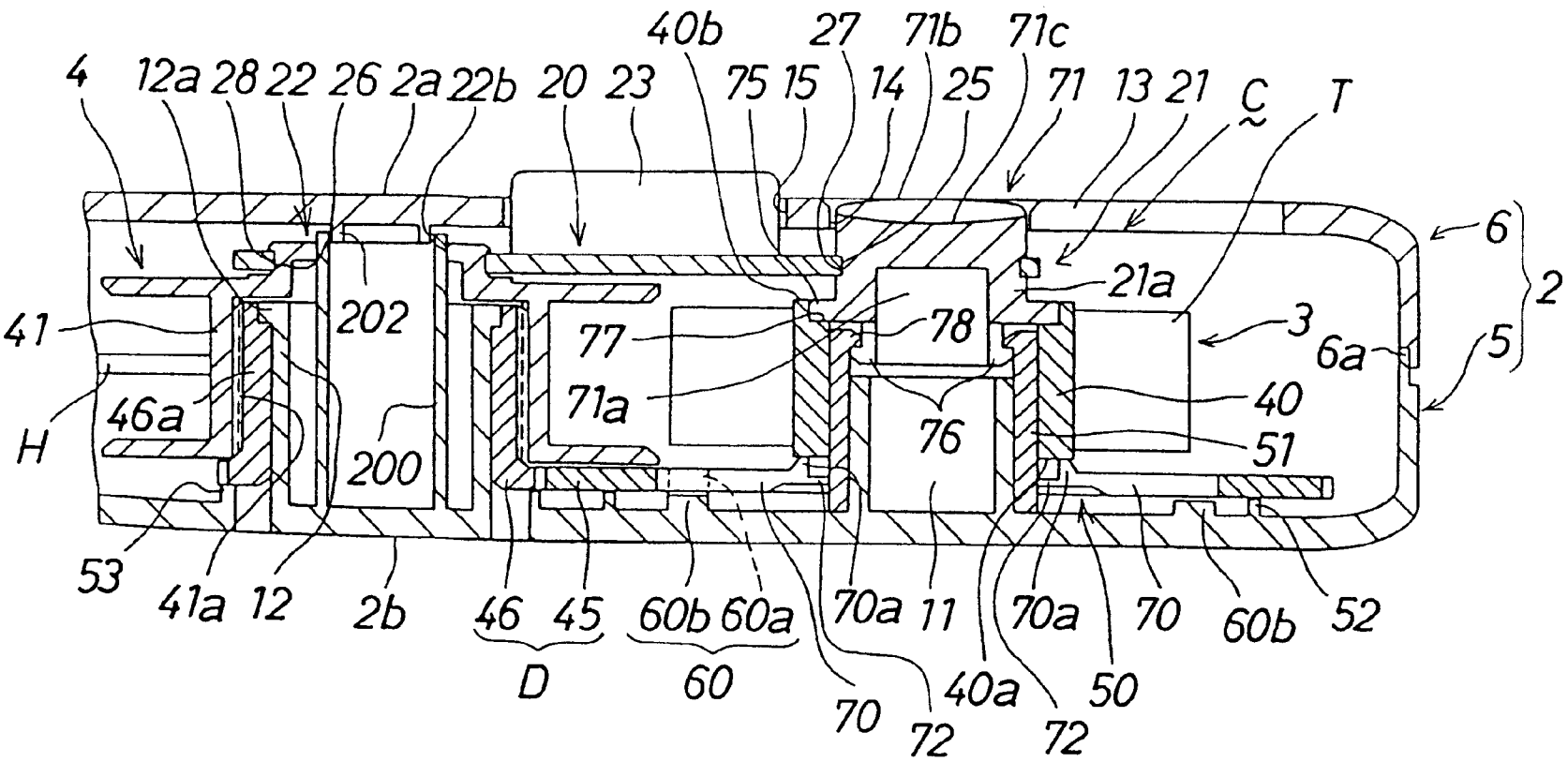
FIG. 27 is a side sectional view showing the inside of principal parts of the eraser.
Figure 28:
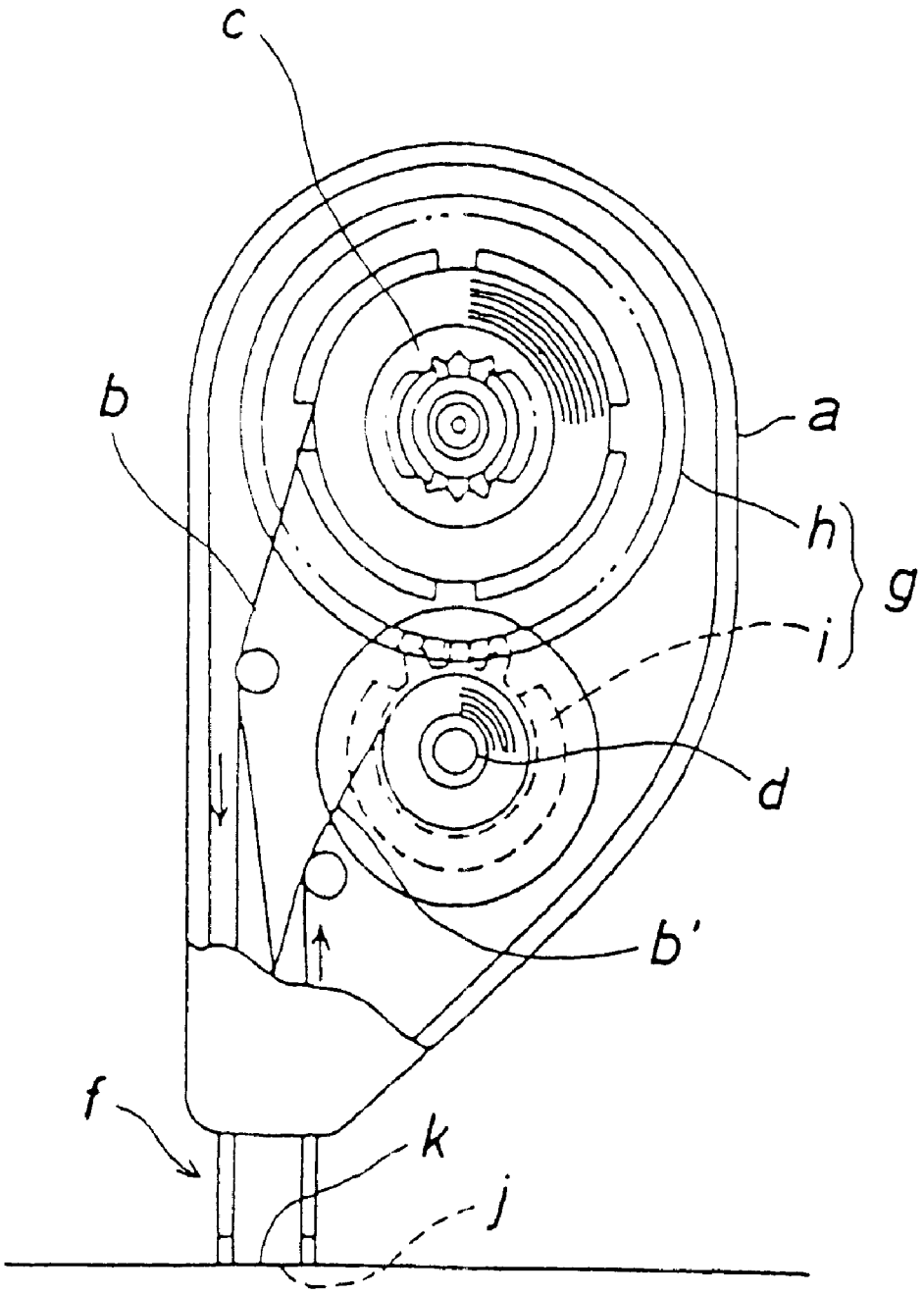
FIG. 28 PRIOR ART
FIG. 28 is a partially cut-way front view of the internal constitution of a conventional eraser.
Figure 29:
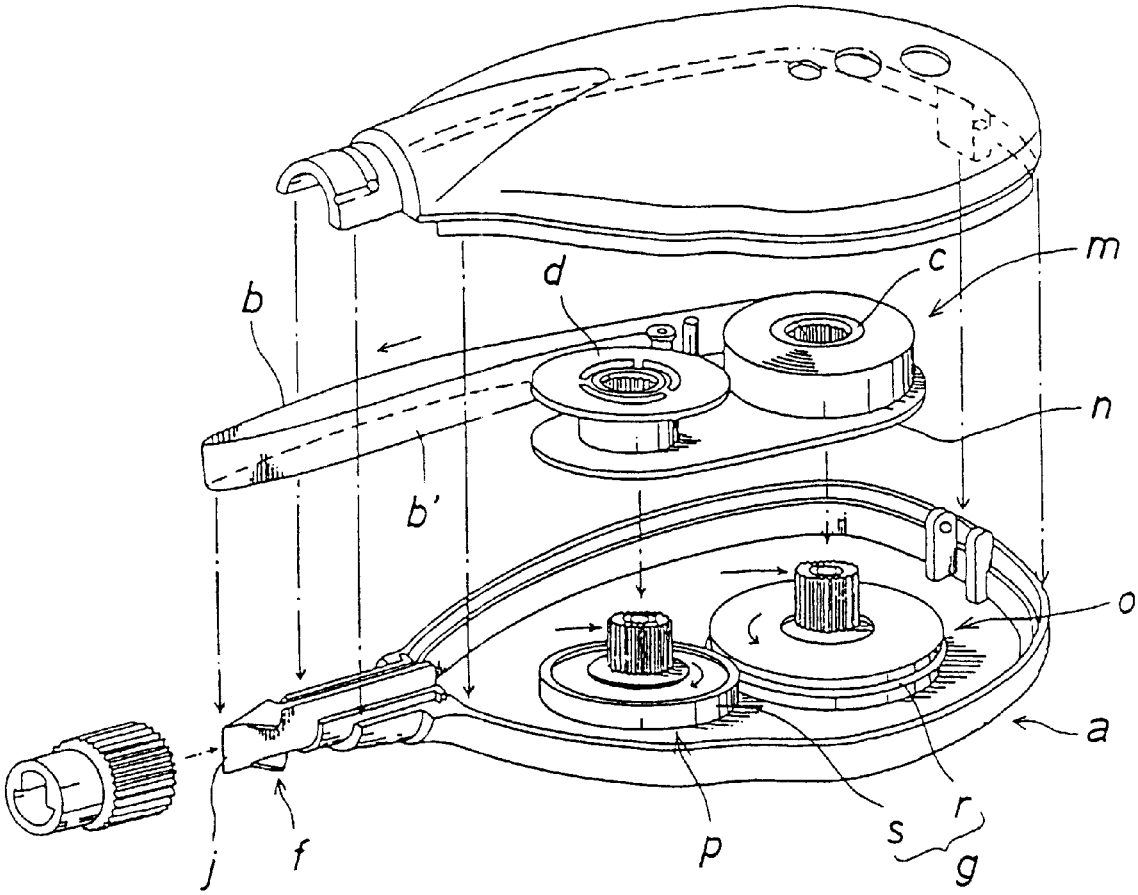
FIG. 29 PRIOR ART
FIG. 29 is a perspective exploded view of other conventional eraser.

This embodiment is shown in FIG. 25 to FIG. 27, in which the constitution of the case 2 is slightly modified.

That is, the case 2 of the embodiment has, in its inside, spacer means for bearing the gripping force applied to the confronting gripping surfaces 2*a*, 2*b* of the case 2.

The location of this spacer means is at least the concentrated position of the gripping force of the user, and more specifically in the gripping position shown in FIG. 10, it corresponds to the position of the confronting gripping surfaces 2*a*, 2*b* of the case 2 held by the thumb and the middle finger, that is, the location of the take-up reel 4.

The spacer means of the embodiment includes a first spacer pat 200 and a second spacer part 201. The first spacer part 200 is provided coaxially with the rotary support shaft 11, and more specifically at the inner side of the case main body 5, it is a form of a spacer shaft integrally formed coaxially inside of the hollow rotary support shaft 11. This spacer shaft 200 is a hollow cylindrical form, and as shown in FIG. 27, it is set in the length corresponding to the height between the inner side faces of the case 2, and a fitting support portion 202 to be fitted to the spacer shaft 200 is provided at the inner side of the cap body 6. In correspondence thereto, at the end face of the rotary shaft 22 of the take-up reel 4, an insertion hole 22*b* for inserting the spacer shaft 200 is opened.

The second spacer part 201 is provided at an outer circumferential position of the take-up reel 4, and more specifically at both inner sides of the case main body 5 and cap body 6, it is a form of a spacer rib integrally formed so as to surround the periphery of the take-up reel 4. This spacer rib 201 is composed of a pair of plate ribs 201*a*, 201*b* disposed oppositely to the inner side of the case main body 5 and the cap body 6. These plate ribs 201*a*, 201*b* are flat arc forms surrounding the periphery of the take-up reel 4, and are set at height suited to the height at both inner sides of the case 2 although not shown in the drawing, and are composed so that both leading end edges may abut against each other.

Thus, the cap body 6 is fitted to cover the case main body 5, and in the closed state of the case 2, the spacer 200 and the fitting support portion 202 are fitted to each other, and the plate ribs 201*a*, 201*b* abut against each other. These spacer means 200, 201 collaborate with the fitting structure of the mutual opening edges of the case main body 5 and cap body 6 and three pairs of positioning fitting parts 9*a*, 9*b* to bear the gripping force applied to the confronting gripping surfaces 2*a*, 2*b* of the case 2 by the user, so that the smooth drive of the take-up reel 4 is assured, in particular.

Such spacer structure is particularly effective when saving the material for the case 2, and setting at a thinner thickness in order to reduce the weight.

The other constitution and action are same as in embodiment 1.

The foregoing embodiments 1 to 12 show preferred embodiments of the invention, and the invention is not limited to them alone, but various design changes are possible within its range. For example, the following modifications may be possible.

(1) In the illustrated embodiments, the clutch mechanism 50 is disposed at the feed reel 3 side, but it may be also disposed at the take-up reel 4 side depending on the purpose, or may be disposed at both reels 3, 4. When the clutch mechanism is provided at both reels 3, 4, in the rewinding operation by the tape rewinding mechanism, action of excessive tension on the coat film transfer tape T can be effectively prevented.

(2) Instead of the corrective paint layer of the coat film transfer tape T in the illustrated coat film transfer tool, by using a paint layer presenting a transparent fluorescent color, the position coated with this paint film may be visually emphasized so that it may be used as a so-called marker coat film transfer tool.

(3) As the coat film transfer tape T, by using a structure of forming an adhesive on one side of the film base material through a peeling layer, the coat film transfer tool may be used as a gluing tool for transferring only the adhesive layer on the sheet of paper.

(4) The constituent parts of the tape cartridge C, in particular, the specific structures of the support board 20 and coat film transfer head H are not limited to the illustrated examples alone as far as the specified objects are achieved.

As described herein, the invention brings about various specific effects as listed below, and in the refill type coat film transfer tool for use in lateral draw, the coat film transfer tape can be replaced easily and promptly, and a small, simple and inexpensive structure can be presented.

(1) The tape cartridge of the invention is composed by integrally forming the coat film transfer head and the flat support board, and the feed reel and take-up reel are rotatably mounted on this support board, so that it can be replaced instantly.

That is, the support board rotatably supports the opposite side ends of the rotary shafts of the reels supported on the rotary support shaft of the case, and setting of the coat film transfer tape on the coat film transfer tape has been already completed in the product stage.

Therefore, the user has only to grip the support board to engage the rotary shaft of the reel with the rotary support shaft of the case from the upper side, and push the tape cartridge into the case while positioning the coat film transfer head into the leading end specified position of the case, so that replacement is over.

(2) The leading end pressurizing portion of the coat film transfer head is in a form of a linear edge extending nearly vertically to the axial line of rotation of the reel supported on the support board, and therefore in the state of the tape cartridge being installed in the case, the leading end pressurizing portion of the coat film transfer head projecting outside from the case leading end guide the coat film transfer tape almost opposite to the gripping surfaces of the case, and therefore when used as an eraser, it is possible to be used in lateral draw suited to correction of part of letters written laterally such as alphabet.

(3) The coat film transfer head and flat support board are plastic plates formed integrally by, for example, injection molding, and therefore the number of parts for composing the tape cartridge as consumable pat can be decreased, the structure is reduced in size and simplified, the product cost is lowered, and the coat film transfer tool itself can be reduced in size.

As a result, while making the best of the merits of the refill type structure such as saving of resources and saving of running cost, the coat film transfer tool itself can be reduced in size, and the portability and ease of operation by holding and manipulating by hand are assured.

(4) The clutch mechanism is composed of the tape core and the rotary drive unit, which are frictionally engaged in the rotating direction by the power transmission means for making use of the frictional force by thrust load, and in the synchronizing operation, the constituent members can slide relatively smoothly, and the feeling in operation is excellent, and uneven running does not occur.

The frictional engaging force of the power transmission means may be set to an optimum value by setting the axial engaging force of the two by properly adjusting the engaging dimensional relation of the rotary drive unit and engaging supporting members in the axial direction, and therefore as compared with the type of making use of frictional force by radial load, the designing and manufacturing conditions of the constituent members are alleviated, and the manufacture is easy, and the assembling work is also easy, so that the manufacturing cost and device cost may be lowered.

The clutch mechanism is simple in constitution and small in the number of constituent parts, and a high assembling precision is achieved while the manufacturing is easy, and it is obtained at low cost, and in this respect, too, the coat film transfer tool itself can be obtained at low cost.

As the invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A tape cartridge for coat film transfer tool, being a tape cartridge installed in a case so as to be replaced, in a self-winding type coat film transfer tool designed to rotate, by interlocking, a feed reel winding a coat film transfer tape therearound, and a take-up reel for collecting the coat film transfer tape after use, comprising:

a flat support board, a coat film transfer head for pressurizing a coat film transfer tape to a transfer area, a feed reel containing a coat film transfer tape, rotatably mounted on said support board, and a take-up reel for collecting the coat film transfer tape, rotatably mounted on said support board, wherein said coat film transfer head and flat support board are integrally formed, the leading end pressurizing portion of said coat film transfer head is a linear edge extending nearly vertically to the axial line of rotation of the reels supported on said support board, and said support board rotatably support the opposite side ends of the rotary shafts of the both reels supported on the rotary support shaft of the case detachably and rotatably.

2. A tape cartridge for coat film transfer tool of claim 1, wherein said coat film transfer head has its base end integrally provided on the support board, and is formed in an elastically deformable plate, and the leading end pressurizing portion of the coat film transfer head is positioned nearly in the central position in the axial direction of the rotary shaft of the reels supported on the support board.

3. A tape cartridge for coat film transfer tool of claim 2, wherein the sectional area of the base end side portion of the coat film transfer head is set smaller than the sectional area of the main body portion, so as to provide the base end side portion of the coat film transfer head with an elasticity.

4. A tape cartridge for coat film transfer tool of claim 3, wherein the base end side portion of the coat film transfer head is formed in a zigzag plane shape, arranging slit notch grooves formed alternately in opposite directions at specified intervals in the longitudinal direction.

5. A tape cartridge for coat film transfer tool of claim 3, wherein the base end side portion of the coat film transfer head is formed as a thin linear bar provided on the head axial direction.

6. A tape cartridge for coat film transfer tool of claim 3, wherein the base end side portion of the coat film transfer head is formed as a pair of thin linear bars extending parallel in the head axial direction.

7. A tape cartridge for coat film transfer tool of claim 1, wherein the rotary support structure of the rotary shafts of the reels on the support board forms a bearing on the outer circumference of the support board, and an annular engaging groove formed on the entire circumference of the opposite side end of the rotary shafts of the reels is engaged and supported with this bearing rotatably, and the bearing is formed in a concave bearing opened to the outer peripheral edge of the support board, and has the shape and dimension for positioning the rotary shafts of the reels rotatably in the specified position.

8. A tape cartridge for coat film transfer tool of claim 1, wherein at least one of the reels is provided with a clutch for synchronizing the feed speed and take-up speed of the coat film transfer tape in both reels.

9. A tape cartridge for coat film transfer tool of claim 8, wherein said clutch mechanism comprises a cylindrical tape core for winding the coat film transfer tape, a rotary drive unit for rotating and driving this tape core, and an engaging support member to be engaged with the rotary drive unit in the axial direction, and the tape core is held and supported from both sides in the axial direction by the rotary drive unit and the engaging support member, and the tape core and the rotary drive unit are frictionally engaged in the rotating direction by the power transmission means for making use of the frictional force by the thrust load.

10. A tape cartridge for coat film transfer tool of claim 9, wherein the power transmission mechanism of said clutch mechanism is composed of plural frictional engaging members elastically deformable in the axial direction provided at least in one of the rotary drive unit and the engaging support member, and these frictional engaging portions are elastically engaged with the axial end face of the tape core with a specified pressing force, by the axial engaging force of the rotary drive unit and engaging support member.

11. A tape cartridge for coat film transfer tool of claim 10, wherein said tape core is supported coaxially and rotatably on the rotary shaft of the rotary drive unit, the frictional engaging members of said power transmission means are engaging protrusions integrally formed at plural positions in at least one circumferential direction of the rotary drive unit and the engaging support member, these engaging protrusions are elastically deformable in the axial direction, and are elastically engaged with a specified pressing force with the confronting flat axial end faces of the tape core by the axial engaging force of the rotary drive unit and engaging support member.

12. A tape cartridge for coat film transfer tool of claim 11, wherein the engaging protrusions of the power transmission means are integrally formed at plural positions in the circumferential directions of the rotary drive unit, and are elastically engaged with a specified pressing force with the confronting flat axial end faces of the tape core by the axial engaging force of the rotary drive unit and engaging support member.

13. A tape cartridge for coat film transfer tool of claim 11, wherein the engaging protrusions of the power transmission means are integrally formed at plural positions in the circumferential directions of the engaging support member, and are elastically engaged with a specified pressing force with the confronting flat axial end faces of the tape core by the axial engaging force of the rotar drive unit and engaging support member.

14. A tape cartridge for coat film transfer tool of claim 11, wherein the engaging protrusions of the power transmission means are integrally formed at plural positions in the circumferential directions of the rotary drive unit and engaging support member, and are elastically engaged with a specified pressing force with the confronting flat axial end faces of the tape core by the axial engaging force of the rotary drive unit and engaging support member.

15. A tape cartridge for coat film transfer tool of claim 11, wherein said engaging support member has an axial engaging portion engaged with the axial end face of the tape core and a stopping pawl engaged with the rotary shaft of said rotary drive unit, and by the engaging force of said axial engaging portion with the tape core when the stopping claw of the engaging support member is engaged with the support portion of the rotary drive unit, the engaging protrusion is elastically engaged with a specified pressing force with the confronting flat axial ends of the tape core.

16. A tape cartridge for coat film transfer tool of claim 15, wherein the stopping claw of said engaging support member is elastically deformable in the radial direction, and an engaging flange to be engaged with the stopping claw in the axial direction is provided in the inner circumference of the rotary drive unit, the stopping claw passes through this engaging flange in the axial direction by elastically deforming to the inner side in the radial direction, and is engaged by its elastic restoration.

17. A tape cartridge for coat film transfer tool of claim 15, wherein the stopping claw of said engaging support member is detachably engaged with the rotary shaft of the rotary drive unit.

18. A tape cartridge for coat film transfer tool of claim 15, wherein said engaging support member is composed of a rotary engaging portion to be engaged with the axial end face of the tape core in the rotating direction, and a rotation operation unit for rotation operation for rewinding.

19. A tape cartridge for coat film transfer tool of claim 18, wherein the axial engaging portion of said engaging support member is in a form of an engaging bump to be engaged with an engaging recess formed at the axial end of the tape core, and functions also as the rotary engaging portion.

20. A tape cartridge for coat film transfer tool of claim 1, wherein the feed reel and take-up reel are of twin-shaft type reel structure independently and rotatably supported on said support board.

21. A tape cartridge for coat film transfer tool of claim 1, wherein the feed reel and take-up reel are of single-shaft type reel structure rotatably supported on said support board, in coaxial and mutually rotatable state.

22. A coat film transfer tool, being a refill type self-winding coat film transfer tool capable of replacing a coat film transfer tape, having a detachable tape cartridge, comprising:

a case held and manipulated by one hand, having a pair of confronting gripping surfaces to be held in a position for holding a writing implement in part of the outer circumference, a tape cartridge replaceably contained in said case, rotatably mounting a feed reel winding a coat film transfer tape therearound, and a take-up reel for collecting the coat film transfer tape after use, on a support board formed integrally with a coat film transfer head, and a rotary support shaft installed in said case for supporting the feed reel and take-up reel of said tape cartridge detachably and rotatably, wherein the feed reel and take-up reel are rotatably held on both sides by the rotary support shaft and the support board of the tape cartridge, and a head inserting portion for projecting the coat film transfer head of the tape cartridge to the outside of the case is provided at the leading end of the case.

23. A coat film transfer tool of claim 22, wherein said tape cartridge comprises a flat support board, a coat film transfer head for pressurizing a coat film transfer tape to a transfer area, a feed reel accommodating a coat film transfer tape rotatably supported on said support board, and a take-up reel for collecting the coat film transfer tape after use rotatably supported on said support board, the coat film transfer head and the flat support board are formed integrally, the leading end pressurizing portion of the coat film transfer head is formed in a linear edge extending nearly vertical to the axial line of rotation of the reels supported on the support board, and the support board rotatably supports the opposite side ends of the rotary shafts of both reels supported on the rotary support shaft of the case.detachably and rotatably.

24. A coat film transfer tool of claim 22, wherein the tape cartridge has the feed reel and take-up reel formed in twin-shaft type reel structure independently and rotatably supported on said support board, a pair of rotary support shafts for supporting the feed reel and take-up reel of the tape cartridge detachably and rotatably are provided in the case, the interlock mechanism for interlocking the feed reel and take-up reel is mutually engaged between the interlock gear provided at one side of the both reels and the interlock gear provided at other side, one interlock gear is rotatably supported on the rotary support shaft for supporting one of the reels, and the other interlock gear is formed integrally in the rotary drive unit of the clutch mechanism provided in other one of the reels.

25. A coat film transfer tool of claim 22, wherein the tape cartridge has the feed reel and take-up reel formed in single-shaft type reel structure rotatably supported on said support board, in coaxial and mutually rotatable state, and the interlock mechanism for interlocking the feed reel and take-up reel is composed of power transmission means of the clutch mechanism provided at one of the two reels.

26. A coat film transfer tool of claim 22, further comprising a tape rewinding mechanism for canceling and clearing slack of coat film transfer tape between two reels, wherein the tape rewinding mechanism has an engaging support member of the clutch mechanism provided opposite to the outside of the case, and a rotation manipulation unit for rewinding rotation operation is formed at the outer end of this engaging support member.

27. A coat film transfer tool of claim 22, further comprising tape position converting means for converting the running position of coat film transfer tape, being disposed between both reels and coat film transfer head.

28. A coat film transfer tool of claim 22, further comprising spacer means for distributing the gripping force applied to the confronting gripping surfaces disposed in the case.

* * * * *